US009061492B2

(12) United States Patent
Watanabe et al.

(10) Patent No.: US 9,061,492 B2
(45) Date of Patent: Jun. 23, 2015

(54) IMAGE RECORDING APPARATUS, IMAGE RECORDING METHOD, AND RECORDING MEDIUM STORING A PROGRAM FOR RECORDING IMAGE

(71) Applicants: Jun Watanabe, Tokyo (JP); Tomoko Fukasawa, Kanagawa (JP); Tetsuyoshi Nakata, Kanagawa (JP); Ryuuichi Satoh, Kanagawa (JP)

(72) Inventors: Jun Watanabe, Tokyo (JP); Tomoko Fukasawa, Kanagawa (JP); Tetsuyoshi Nakata, Kanagawa (JP); Ryuuichi Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/197,807

(22) Filed: Mar. 5, 2014

(65) Prior Publication Data

US 2014/0253620 A1 Sep. 11, 2014

(30) Foreign Application Priority Data

| | | |
|---|---|---|
| Mar. 7, 2013 | (JP) | 2013-045789 |
| Apr. 2, 2013 | (JP) | 2013-077194 |
| May 7, 2013 | (JP) | 2013-097982 |
| May 23, 2013 | (JP) | 2013-109261 |

(51) Int. Cl.
*B41J 29/38* (2006.01)
*B41J 2/045* (2006.01)

(52) U.S. Cl.
CPC ..... *B41J 2/04588* (2013.01); *B41J 2/04503* (2013.01); *B41J 2/04551* (2013.01); *B41J 2/04563* (2013.01); *B41J 2/04568* (2013.01); *B41J 2/04586* (2013.01); *B41J 2/04593* (2013.01); *B41J 2/04596* (2013.01)

(58) Field of Classification Search
CPC ..... B41J 2/04588; B41J 2/04596; B41J 2/04573; B41J 2/04563; B41J 2/04593
USPC ..... 347/9–11, 19
See application file for complete search history.

(56) References Cited

U.S. PATENT DOCUMENTS

| | | | | |
|---|---|---|---|---|
| 6,712,445 | B2 * | 3/2004 | Yonekubo | 347/19 |
| 7,581,802 | B2 * | 9/2009 | Tabata et al. | 347/11 |
| 7,748,812 | B2 * | 7/2010 | Oshima | 347/11 |
| 8,096,633 | B2 * | 1/2012 | Takahashi | 347/14 |
| 8,136,912 | B2 * | 3/2012 | Nakano | 347/19 |

(Continued)

FOREIGN PATENT DOCUMENTS

| | | |
|---|---|---|
| JP | 2000-238262 | 9/2000 |
| JP | 2001-129991 | 5/2001 |
| JP | 2008-254204 | 10/2008 |

OTHER PUBLICATIONS

European Search Report dated May 30, 2014 issued in corresponding European Application No. 14157987.0.

*Primary Examiner* — An Do
(74) *Attorney, Agent, or Firm* — Harness, Dickey & Pierce, P.L.C.

(57) ABSTRACT

An image recording apparatus that includes a recording head controller that transfers image data and a driving waveform to a recording head in conjunction with position information of the recording head. The recording head controller includes a driving waveform storage unit that stores multiple driving waveform data, a number of driven nozzles calculator that calculates the number of nozzles driven simultaneously from the image data, and a driving waveform selector that selects one driving waveform data from the multiple driving waveform data based on the calculated number of driven nozzles and a predetermined threshold value of the number of driven nozzles.

16 Claims, 30 Drawing Sheets

(56) References Cited

U.S. PATENT DOCUMENTS

| | | | | |
|---|---|---|---|---|
| 8,220,892 | B2 * | 7/2012 | Naoi | 347/11 |
| 2003/0103095 | A1 | 6/2003 | Imai | |
| 2004/0021719 | A1 | 2/2004 | Umezawa | |
| 2005/0062804 | A1 | 3/2005 | Eaton | |
| 2008/0018685 | A1 | 1/2008 | Tabata et al. | |
| 2009/0289980 | A1 | 11/2009 | Tabata et al. | |

* cited by examiner

| IMAGE DATA | | EJECTED DROPLET SIZE |
|---|---|---|
| HIGHER BIT | LOWER BIT | |
| 0 | 0 | NO DROPLET |
| 0 | 1 | SMALL DROPLET |
| 1 | 0 | MEDIUM DROPLET |
| 1 | 1 | LARGE DROPLET |

FIG. 13

| DRIVING PULSE NUMBER | THRESHOLD OF NUMBER OF DRIVEN NOZZLES | METHOD OF SELECTING DRIVING WAVEFORM |
|---|---|---|
| (1) | 400 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| (2) | 100 NOZZLES | |
| (3) | 200 NOZZLES | |
| (4) | 300 NOZZLES | |

FIG. 14

| COMBINATION OF TARGET DROPLET SIZES | THRESHOLD OF NUMBER OF DRIVEN NOZZLES | METHOD OF SELECTING DRIVING WAVEFORM |
|---|---|---|
| LARGE DROPLET, MEDIUM DROPLET, AND SMALL DROPLET | 700 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| LARGE DROPLET AND MEDIUM DROPLET | 600 NOZZLES | |
| LARGE DROPLET AND SMALL DROPLET | 400 NOZZLES | |
| LARGE DROPLET | 300 NOZZLES | |
| MEDIUM DROPLET AND SMALL DROPLET | 500 NOZZLES | |
| MEDIUM DROPLET | 200 NOZZLES | |
| SMALL DROPLET | 100 NOZZLES | |

FIG. 15

| PRINT MODE | THRESHOLD OF NUMBER OF DRIVEN NOZZLES | METHOD OF SELECTING DRIVING WAVEFORM |
|---|---|---|
| HIGH SPEED | 100 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| FAST | 200 NOZZLES | |
| FINE | 300 NOZZLES | |
| HIGH QUALITY | 400 NOZZLES | |

FIG. 16

| RECORDING HEAD TEMPERATURE | THRESHOLD OF NUMBER OF DRIVEN NOZZLES | METHOD OF SELECTING DRIVING WAVEFORM |
|---|---|---|
| -10°C | 100 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| 10-20°C | 200 NOZZLES | |
| 20-30°C | 300 NOZZLES | |
| 30°C- | 400 NOZZLES | |

FIG. 17

| MAIN SCANNING VELOCITY | THRESHOLD OF NUMBER OF DRIVEN NOZZLES | METHOD OF SELECTING DRIVING WAVEFORM |
|---|---|---|
| -500mm/s | 100 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| 500-700mm/s | 200 NOZZLES | |
| 700-900mm/s | 300 NOZZLES | |
| 900mm/s- | 400 NOZZLES | |

FIG. 18

| MAIN SCANNING POSITION | THRESHOLD OF NUMBER OF DRIVEN NOZZLES | METHOD OF SELECTING DRIVING WAVEFORM |
|---|---|---|
| ACCELERATION STAGE | 100 NOZZLES | SELECT WAVEFORM a IF NUMBER OF DRIVEN NOZZLES IS SMALLER THAN THRESHOLD OF NUMBER OF DRIVING NOZZLES<br>SELECT WAVEFORM b IF NUMBER OF DRIVEN NOZZLES IS EITHER LARGER THAN OR EQUAL TO THRESHOLD OF NUMBER OF DRIVING NOZZLES |
| CONSTANT VELOCITY STAGE | 300 NOZZLES | |
| DECELERATION STAGE | 200 NOZZLES | |

FIG. 20

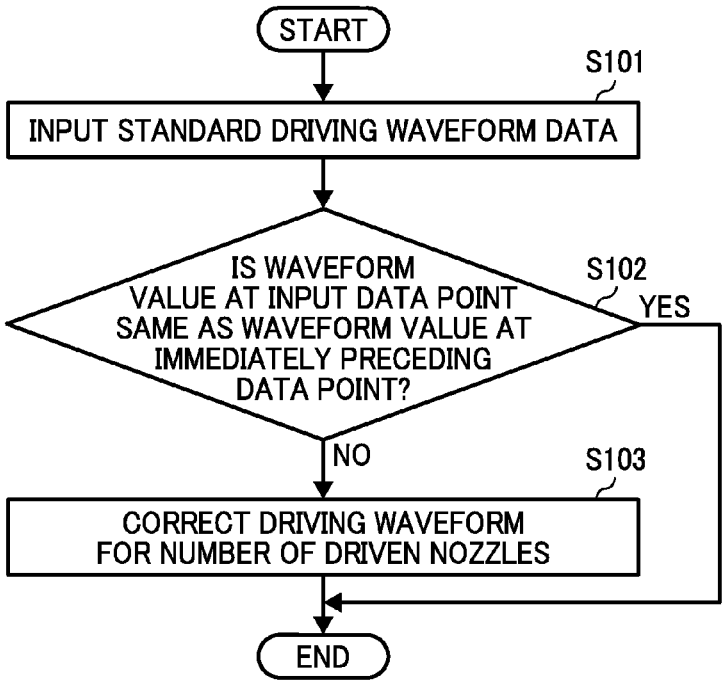

FIG. 21

| NUMBER OF NOZZLES | DIFFERENCE BETWEEN PREVIOUS AND CURRENT DRIVING WAVEFORM | CORRECTION COEFFICIENT |
|---|---|---|
| 100 | $1 \leq \lvert X \rvert \leq 10$ | ±3% |
| | $11 \leq \lvert X \rvert \leq 20$ | ±5% |
| | $21 \leq \lvert X \rvert$ | ±10% |
| 300 | $1 \leq \lvert X \rvert \leq 20$ | ±5% |
| | $21 \leq \lvert X \rvert \leq 40$ | ±10% |
| | $41 \leq \lvert X \rvert$ | ±14% |

EQUATION 2 ··· |(N-1TH DRIVING WAVEFORM DATA) − (NTH DRIVING WAVEFORM DATA)| × CORRECTION COEFFICIENT

FIG. 22

| NUMBER OF NOZZLES | DIFFERENCE BETWEEN PREVIOUS AND CURRENT DRIVING WAVEFORM | CORRECTION VALUE |
|---|---|---|
| 100 | $1 \leq \lvert X \rvert \leq 10$ | ±5% |
| | $11 \leq \lvert X \rvert \leq 20$ | ±10% |
| | $21 \leq \lvert X \rvert$ | ±20% |
| 300 | $1 \leq \lvert X \rvert \leq 20$ | ±5% |
| | $21 \leq \lvert X \rvert \leq 40$ | ±12% |
| | $41 \leq \lvert X \rvert$ | ±22% |

EQUATION 3 ··· |(N-1TH DRIVING WAVEFORM DATA) - (NTH DRIVING WAVEFORM DATA)| ± CORRECTION VALUE

FIG. 23

| DRIVING PULSE NUMBER | THRESHOLD OF NUMBER OF DRIVEN NOZZLES | METHOD OF OPERATING DRIVING WAVEFORM |
|---|---|---|
| (1) | 400 NOZZLES | OPERATING METHOD OF EITHER FIG. 21 (MULTIPLICATION) OR FIG. 22 (ADDITION OR SUBTRACTION) |
| (2) | 100 NOZZLES | |
| (3) | 200 NOZZLES | |
| (4) | 300 NOZZLES | |

FIG. 24

| PRINT MODE | THRESHOLD OF NUMBER OF DRIVEN NOZZLES | METHOD OF OPERATING DRIVING WAVEFORM |
|---|---|---|
| HIGH SPEED | 100 NOZZLES | OPERATING METHOD OF EITHER FIG. 21 (MULTIPLICATION) OR FIG. 22 (ADDITION OR SUBTRACTION) |
| FAST | 200 NOZZLES | |
| FINE | 300 NOZZLES | |
| HIGH QUALITY | 400 NOZZLES | |

FIG. 25

| RECORDING HEAD TEMPERATURE | THRESHOLD OF NUMBER OF DRIVEN NOZZLES | METHOD OF OPERATING DRIVING WAVEFORM |
|---|---|---|
| -10°C | 100 NOZZLES | OPERATING METHOD OF EITHER FIG. 21 (MULTIPLICATION) OR FIG. 22 (ADDITION OR SUBTRACTION) |
| 10-20°C | 200 NOZZLES | |
| 20-30°C | 300 NOZZLES | |
| 30°C- | 400 NOZZLES | |

FIG. 26

| MAIN SCANNING VELOCITY | THRESHOLD OF NUMBER OF DRIVEN NOZZLES | METHOD OF OPERATING DRIVING WAVEFORM |
|---|---|---|
| -500mm/s | 100 NOZZLES | OPERATING METHOD OF EITHER FIG. 21 (MULTIPLICATION) OR FIG. 22 (ADDITION OR SUBTRACTION) |
| 500-700mm/s | 200 NOZZLES | |
| 700-900mm/s | 300 NOZZLES | |
| 900mm/s- | 400 NOZZLES | |

| MAIN SCANNING POSITION | THRESHOLD OF NUMBER OF DRIVEN NOZZLES | METHOD OF OPERATING DRIVING WAVEFORM |
|---|---|---|
| ACCELERATION STAGE | 100 NOZZLES | OPERATING METHOD OF EITHER FIG. 21 (MULTIPLICATION) OR FIG. 22 (ADDITION OR SUBTRACTION) |
| CONSTANT VELOCITY STAGE | 300 NOZZLES | |
| DECELERATION STAGE | 200 NOZZLES | |

| NUMBER OF CONSECUTIVE TIMES | CORRECTION VALUE (α) |
|---|---|
| 1 | ±0 |
| 2 | ±5 |
| 3 | ±10 |
| 4 | ±15 |

FIG. 32

| DRIVING PULSE NUMBER | THRESHOLD OF NUMBER OF DRIVEN NOZZLES | METHOD OF SELECTING DELAY DATA |
|---|---|---|
| (1) | 400 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| (2) | 100 NOZZLES | |
| (3) | 200 NOZZLES | |
| (4) | 300 NOZZLES | |

FIG. 33

| COMBINATION OF TARGET DROPLET SIZES | THRESHOLD OF NUMBER OF DRIVEN NOZZLES | METHOD OF SELECTING DELAY DATA |
|---|---|---|
| LARGE DROPLET, MEDIUM DROPLET, AND SMALL DROPLET | 700 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| LARGE DROPLET AND MEDIUM DROPLET | 600 NOZZLES | |
| LARGE DROPLET AND SMALL DROPLET | 400 NOZZLES | |
| LARGE DROPLET | 300 NOZZLES | |
| MEDIUM DROPLET AND SMALL DROPLET | 500 NOZZLES | |
| MEDIUM DROPLET | 200 NOZZLES | |
| SMALL DROPLET | 100 NOZZLES | |

FIG. 34

| PRINT MODE | THRESHOLD OF NUMBER OF DRIVEN NOZZLES | METHOD OF SELECTING DELAY DATA |
|---|---|---|
| HIGH SPEED | 100 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| FAST | 200 NOZZLES | |
| FINE | 300 NOZZLES | |
| HIGH QUALITY | 400 NOZZLES | |

FIG. 35

| RECORDING HEAD TEMPERATURE | THRESHOLD OF NUMBER OF DRIVEN NOZZLES | METHOD OF SELECTING DELAY DATA |
|---|---|---|
| -10°C | 100 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| 10-20°C | 200 NOZZLES | |
| 20-30°C | 300 NOZZLES | |
| 30°C- | 400 NOZZLES | |

FIG. 36

| MAIN SCANNING VELOCITY | THRESHOLD OF NUMBER OF DRIVEN NOZZLES | METHOD OF SELECTING DELAY DATA |
|---|---|---|
| -500mm/s | 100 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| 500-700mm/s | 200 NOZZLES | |
| 700-900mm/s | 300 NOZZLES | |
| 900mm/s- | 400 NOZZLES | |

FIG. 37

| MAIN SCANNING POSITION | THRESHOLD OF NUMBER OF DRIVEN NOZZLES | METHOD OF SELECTING DELAY DATA |
|---|---|---|
| ACCELERATION STAGE | 100 NOZZLES | SELECT DELAY DATA a IF NUMBER OF DRIVEN NOZZLES IS SMALLER THAN THRESHOLD OF NUMBER OF DRIVING NOZZLES<br>SELECT DELAY DATA b IF NUMBER OF DRIVEN NOZZLES IS EITHER LARGER THAN OR EQUAL TO THRESHOLD OF NUMBER OF DRIVING NOZZLES |
| CONSTANT VELOCITY STAGE | 300 NOZZLES | |
| DECELERATION STAGE | 200 NOZZLES | |

| NUMBER OF DRIVEN NOZZLES | METHOD OF SELECTING DRIVING WAVEFORM |
|---|---|
| EITHER LARGER THAN OR EQUAL TO 210 | SELECT WAVEFORM b |
| EITHER LARGER THAN OR EQUAL TO 190 AND SMALLER THAN 210 | MAINTAIN PREVIOUS DRIVING WAVEFORM |
| SMALLER THAN 190 | SELECT WAVEFORM a |

FIG. 42

| NUMBER OF DRIVEN NOZZLES | DIFFERENCE BETWEEN PREVIOUS AND CURRENT NUMBER OF DRIVEN NOZZLES | METHOD OF SELECTING DRIVING WAVEFORM |
|---|---|---|
| EITHER LARGER THAN OR EQUAL TO 250 | NO CONDITIONS | SELECT WAVEFORM b |
| EITHER LARGER THAN OR EQUAL TO 150 AND SMALLER THAN 250 | EITHER LARGER THAN OR EQUAL TO +50 | SELECT WAVEFORM b |
| | EITHER LARGER THAN OR EQUAL TO −50 AND SMALLER THAN +50 | MAINTAIN PREVIOUS DRIVING WAVEFORM |
| | SMALLER THAN −50 | SELECT WAVEFORM a |
| SMALLER THAN 150 | NO CONDITIONS | SELECT WAVEFORM a |

FIG. 43

| NUMBER OF DRIVEN NOZZLES | DIFFERENCE BETWEEN PREVIOUS AND CURRENT NUMBER OF DRIVEN NOZZLES | METHOD OF SELECTING DRIVING WAVEFORM |
|---|---|---|
| EITHER LARGER THAN OR EQUAL TO 250 | NO CONDITIONS | SELECT WAVEFORM b |
| EITHER LARGER THAN OR EQUAL TO 150 AND SMALLER THAN 250 | EITHER LARGER THAN OR EQUAL TO (250 − NUMBER OF DRIVEN NOZZLES) | SELECT WAVEFORM b |
| | EITHER LARGER THAN OR EQUAL TO (150 − NUMBER OF DRIVEN NOZZLES) AND SMALLER THAN (250 − NUMBER OF DRIVEN NOZZLES) | MAINTAIN PREVIOUS DRIVING WAVEFORM |
| | SMALLER THAN (150 − NUMBER OF DRIVEN NOZZLES) | SELECT WAVEFORM a |
| SMALLER THAN 150 | NO CONDITIONS | SELECT WAVEFORM a |

| HEAD SCANNING DIRECTION | THRESHOLD OF DRIVEN NOZZLES | THRESHOLD OF VARIATION IN NUMBER OF DRIVEN NOZZLES |
|---|---|---|
| FORWARD DIRECTION | 210 | 260 |
| | | 160 |
| BACKWARD DIRECTION | 190 | 240 |
| | | 140 |

FIG. 46

| NUMBER OF SCANS | THRESHOLD OF DRIVEN NOZZLES | THRESHOLD OF VARIATION IN NUMBER OF DRIVEN NOZZLES |
|---|---|---|
| 4NTH SCAN | 215 | 265 |
| | | 165 |
| 4N+1TH SCAN | 205 | 255 |
| | | 155 |
| 4N+2TH SCAN | 195 | 245 |
| | | 145 |
| 4N+3TH SCAN | 185 | 235 |
| | | 135 |

IMAGE RECORDING APPARATUS, IMAGE RECORDING METHOD, AND RECORDING MEDIUM STORING A PROGRAM FOR RECORDING IMAGE

CROSS-REFERENCE TO RELATED APPLICATIONS

This patent application is based on and claims priority pursuant to 35 U.S.C. §119(a) to Japanese Patent Application No. 2013-045789, filed on Mar. 7, 2013; No. 2013-077194, filed on Apr. 2, 2013; No. 2013-097982, filed on May 7, 2013; and No. 2013-109261, filed on May 23, 2013 in the Japan Patent Office, the entire disclosures of which are hereby incorporated by reference herein.

BACKGROUND

1. Technical Field

The present invention relates to an image recording apparatus, image recording method, and recording medium storing a program for recording an image.

2. Background Art

In image recording apparatuses, e.g., inkjet recording apparatuses, a recording head that consists of multiple driven nozzles that discharge ink droplets (ink discharging nozzles) is mounted on a carriage. Images are formed by moving (main scanning) the carriage in the direction perpendicular to the recording medium carrying direction and discharging ink droplets.

If the number of nozzles that discharge ink droplets simultaneously changes, since load to drive the nozzles (capacitance) changes too, rise time and fall time of the driving waveform changes and discharging velocity of the ink droplets becomes unstable. There then arise problems such as increasing satellites (mist) due to overshoot and undershoot in the driving waveform.

FIG. 11 is a diagram illustrating head driving waveforms for each of driven nozzles that discharge ink droplets simultaneously. In FIG. 11, the ordinate indicates head driving voltage and the abscissa indicates time.

In the driving waveforms shown in FIG. 11, the number of driven nozzles that discharge ink droplets simultaneously is small (189 nozzles) in driving waveform (1), and rise time and fall time are short (i.e., ideal waveform). By contrast, in driving waveform (2), the number of driven nozzles that discharge ink droplets simultaneously is large (756 nozzles), and rise time and fall time become long (i.e., dull waveform). This difference in waveform increases with the total number of nozzles in the recording head and with the per-nozzle load of discharging ink droplets.

To solve this issue, a technology that includes multiple driving circuits, selects a driving circuit to be used in accordance with the number of driven nozzles, and adjusts driving capability is well known. The image recording apparatus described in JP-2008-254204-A includes a driving circuit that drives a recording head that includes recording elements. In the recording head driving circuit, multiple driving circuits are connected to one recording element in parallel. The recording head driving circuit includes an output circuit block that converts voltage supplied from a power supply into driving voltage that has a predetermined waveform, a recorded data integrator that integrates the number of the recording elements based on recorded data, and a driving circuit selector that selects at least one driving circuit from the multiple driving circuits so that on resistance of the output circuit block becomes less than a predetermined value in accordance with the integrated value calculated by the recorded data integrator.

However, such an approach entails an increase in cost due to the presence of multiple driving circuits.

SUMMARY

An example embodiment of the present invention provides an image recording apparatus that includes a recording head controller that transfers image data and a driving waveform to a recording head in conjunction with position information of the recording head. The recording head controller includes a driving waveform storage unit that stores multiple driving waveform data, a number of driven nozzles calculator that calculates the number of nozzles driven simultaneously from the image data, and a driving waveform selector that selects one driving waveform data from the multiple driving waveform data based on the calculated number of driven nozzles and a predetermined threshold value of the number of driven nozzles.

An example embodiment of the present invention include a recording method of using the image recording apparatus, and a non-transitory recording medium storing a program that causes a computer to implement the recording method of using the image recording apparatus.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

FIG. 13 is a setting table illustrating a first example configuration of threshold value of the number of driven nozzles as an embodiment of the present invention.

FIG. 14 is a setting table illustrating a second example configuration of threshold value of the number of driven nozzles as an embodiment of the present invention.

FIG. 15 is a setting table illustrating a third example configuration of threshold value of the number of driven nozzles as an embodiment of the present invention.

FIG. 16 is a setting table illustrating a fourth example configuration of threshold value of the number of driven nozzles as an embodiment of the present invention.

FIG. 17 is a setting table illustrating a fifth example configuration of threshold value of the number of driven nozzles as an embodiment of the present invention.

FIG. 18 is a setting table illustrating a sixth example configuration of threshold value of the number of driven nozzles as an embodiment of the present invention.

FIG. 20 is a flowchart illustrating a process for correcting a driving waveform as an embodiment of the present invention.

FIG. 21 is a first example of correction table illustrating correction coefficients used for calculation of correcting a driving waveform associated with the number of driven nozzles and difference |X| and correction operational expressions as an embodiment of the present invention.

FIG. 22 is a second example of correction table illustrating correction values used for calculation of correcting a driving waveform associated with the number of driven nozzles and difference |X| and correction operational expressions as an embodiment of the present invention.

FIG. 23 is a third example of correction table used for correcting a driving waveform illustrating threshold values of the number of driven nozzles configured for each of driving periods of driving pulses that correspond to ink droplet sizes as an embodiment of the present invention.

FIG. 24 is a fourth example of correction table for correcting a driving waveform illustrating threshold values of the number of driven nozzles configured for each of different print modes as an embodiment of the present invention.

FIG. 25 is a fifth example of correction table for correcting a driving waveform illustrating threshold values for the number of driven nozzles configured for each of different temperature of recording heads as an embodiment of the present invention.

FIG. 26 is a sixth example of correction table for correcting a driving waveform illustrating threshold values for the number of driven nozzles configured for each of different main scanning velocities as an embodiment of the present invention.

FIG. 32 is a setting table illustrating a first example configuration of threshold value of the number of driven nozzles as an embodiment of the present invention.

FIG. 33 is a setting table illustrating a second example configuration of threshold value of the number of driven nozzles as an embodiment of the present invention.

FIG. 34 is a setting table illustrating a third example configuration of threshold value of the number of driven nozzles as an embodiment of the present invention.

FIG. 35 is a setting table illustrating a fourth example configuration of threshold value of the number of driven nozzles as an embodiment of the present invention.

FIG. 36 is a setting table illustrating a fifth example configuration of threshold value of the number of driven nozzles as an embodiment of the present invention.

FIG. 37 is a setting table illustrating a sixth example configuration of threshold value of the number of driven nozzles as an embodiment of the present invention.

FIG. 42 is a table illustrating another control method of switching the driving waveform using hysteresis characteristics as an embodiment of the present invention.

FIG. 43 is a table illustrating yet another control method of switching the driving waveform using hysteresis characteristics as an embodiment of the present invention.

FIG. 46 is a table illustrating relationship between the numbers of scans, threshold values of the number of driven nozzles, and threshold values of variation as an embodiment of the present invention.

DETAILED DESCRIPTION

Figure 1:
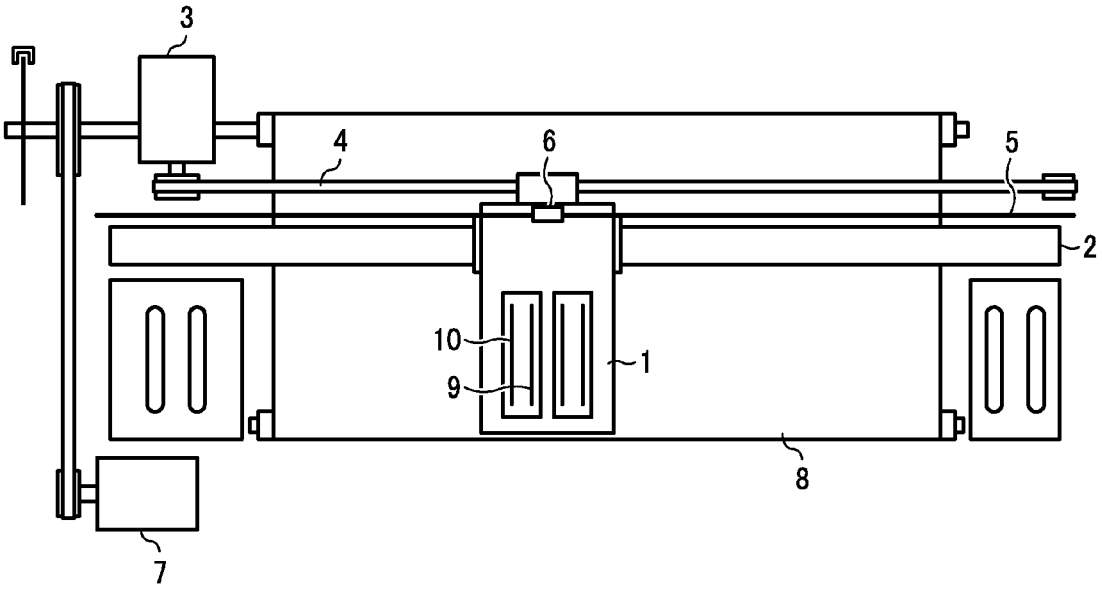
FIG. 1 is a schematic diagram illustrating a basic configuration of an inkjet recording apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

First Embodiment

In the following example embodiment, in outputting driving waveform in an image recording apparatus, driving waveform can be prevented from being unstable due to variation of load of recording head depending on the number of driven nozzles without using conventional complicated driving circuit.

FIG. 1 is a schematic diagram illustrating a basic configuration of an inkjet recording apparatus in this embodiment.

A carriage 1 is held by a guide rod 2 and scans in the main scanning direction via a belt 4 hanged between a main scanning motor 3. The carriage 1 includes a recording head 9 that discharges ink droplets in colors such as yellow (Y), cyan (C), magenta (M), and black (K) for example, and ink droplets are discharged from driven nozzles 10 (ink discharging nozzles) laid out on the recording head 9. An image is formed on a recording medium by moving the carriage 1 in the main scanning direction and discharging ink droplets at necessary positions.

The position information of the carriage 1 can be acquired by reading patterns recorded at even intervals on an encoder sheet 5 mounted on a case by an encoder sensor 6 mounted on the carriage 1 and adding/subtracting counts.

An image for a band whose width is the same as length of nozzle row is formed by moving the carriage 1 in the main scanning direction and discharging ink droplets once. After finishing forming the image for one band, an image can be formed at any place on the recording medium by repeating moving the recording medium in the sub-scanning direction by driving a sub-scanning motor 7 and performing the image forming operation for one band.

Figure 2:
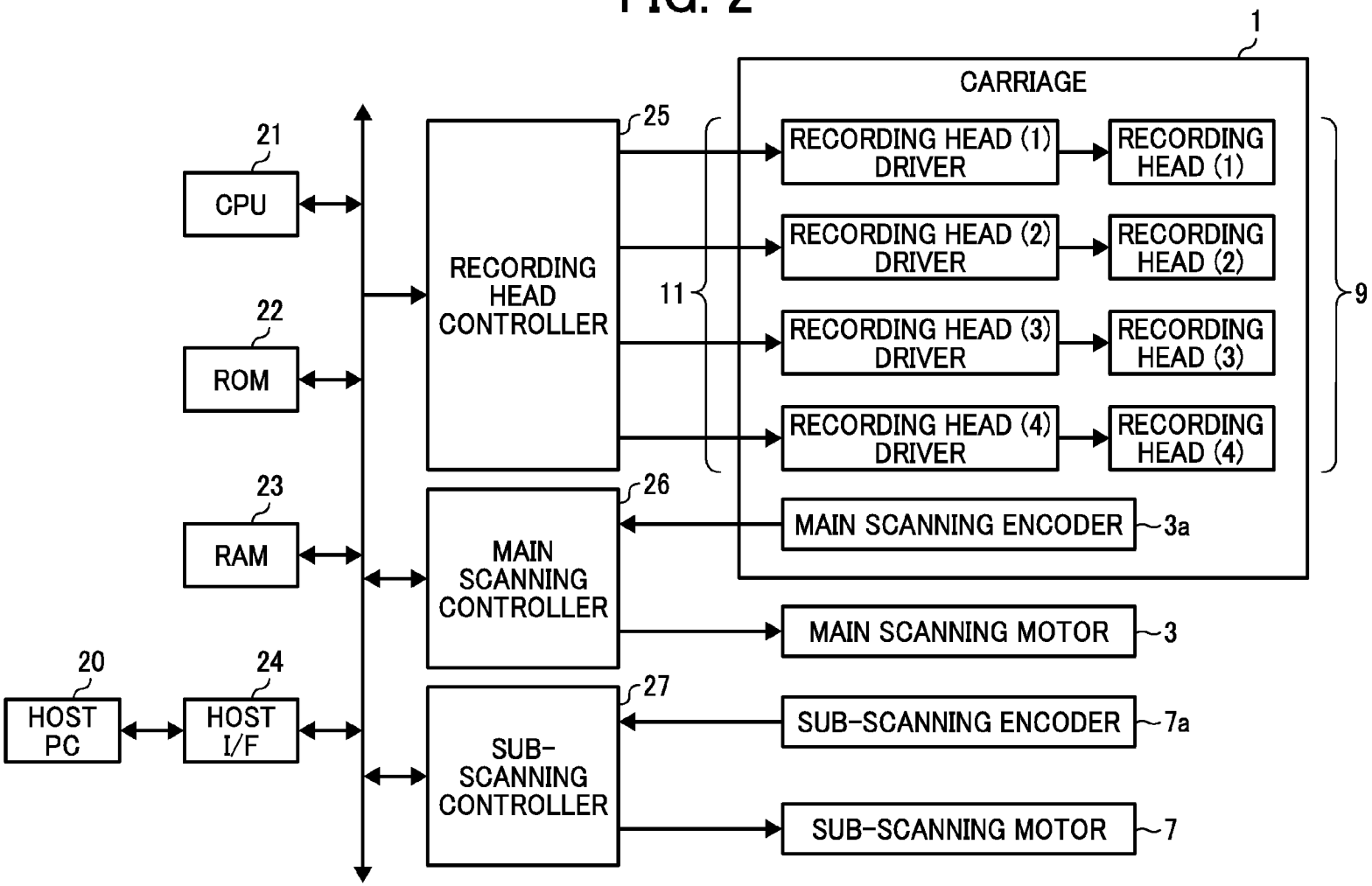
FIG. 2 is a block diagram illustrating a functional configuration of the inkjet recording apparatus as an embodiment of the present invention.

FIG. 2 is a block diagram illustrating a functional configuration of the inkjet recording apparatus. Firmware for controlling hardware of the printer and driving waveform data of the recording head are stored in a Read Only Memory (ROM) 22. After receiving a print job (image data) from a host Personal Computer (PC) 20 via a host interface (I/F) 24, a Central Processing Unit (CPU) 21 stores the image data in a Random Access Memory (RAM) 23. Concurrently, the CPU 21 instructs a main scanning controller 26 to move the carriage 1 on which the recording head 9 is mounted to arbitrary position on a recording medium 8.

A recording head controller 25 transfers the image data stored in the RAM 23, the recording head driving waveform stored in the ROM 22, and a control signal to a recording head driver 11 in conjunction with position information of the carriage 1 acquired from a main scanning encoder 3*a* (i.e., position information of the recording head 9).

The recording head driver 11 drives the recording head 9 based on the data transferred from the recording head controller 25 and discharges ink droplets.

Figure 3:
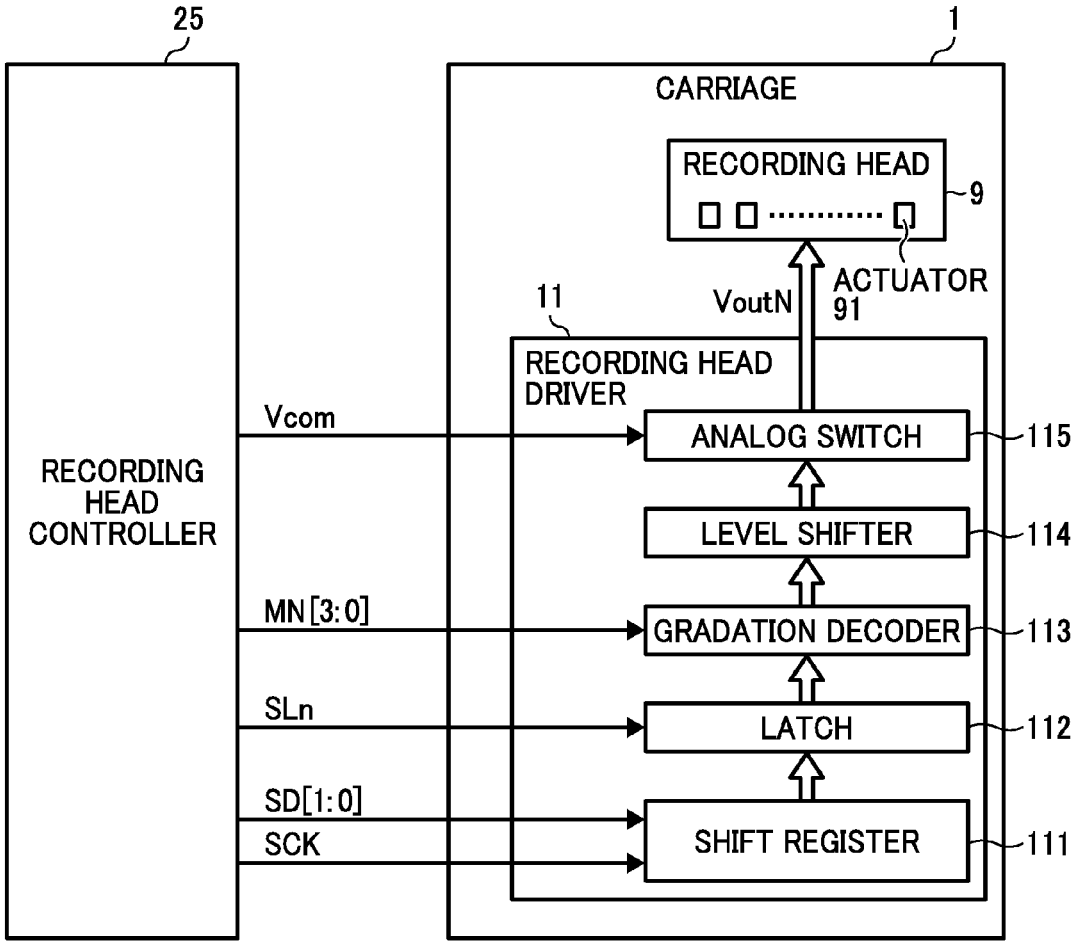
FIG. 3 is a block diagram illustrating a recording head driving unit as an embodiment of the present invention.
Figure 4:
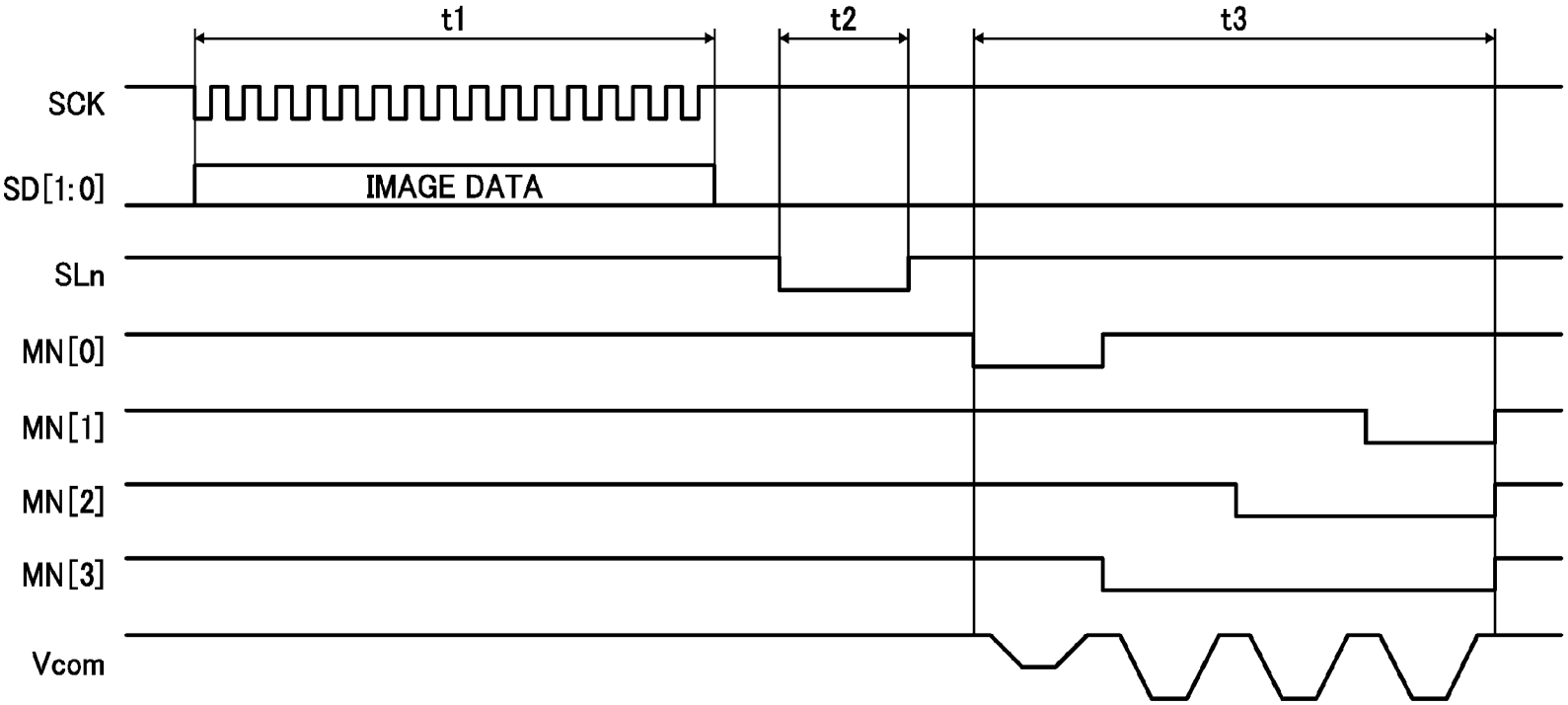
FIG. 4 is a timing chart illustrating operation of driving a recording head as an embodiment of the present invention.

FIG. 3 is a block diagram illustrating the recording head driving unit 11, and FIG. 4 is a timing chart illustrating operation of driving the recording head.

In FIG. 3 and FIG. 4, SCK indicates an image data transfer clock, SD indicates image data (serial data), SLn indicates a image data latch signal, MN indicates a head driving mask pattern, and Vcom indicates a head driving waveform (analog). In FIG. 3, VoutN indicates a head driving waveform (driven nozzle N) after decoding gradation.

The recording head controller 25 transfers image data (serial data) SD for the number of nozzles of the recording head 9 (that equals the number of actuators) to a shift register 111 for image data in the recording head driver 11 by using the image data transfer clock SCK (t1 in FIG. 4).

After finishing transferring, the image data (serial data) SD is stored in a latch 112 for each image data for each driven nozzle 10 by using the image data latch signal SLn (t2 in FIG. 4).

After latching the image data, the recording head controller 25 outputs the head driving waveform Vcom to instruct the nozzles to discharge ink droplets at each gradation value (t3 in FIG. 4). In this case, the head driving mask patterns from MN(0) to MN(3) are input into a gradation decoder 113 as a gradation control signal and transitioned to a level shifter 114 so that they are selected in accordance with timing of outputting the head driving waveform Vcom.

That is, logical operation is performed with the gradation control signal from MN(0) to MN(3) and the latched image data SD in the recording head driver 11, and that results in generating the head driving waveform VoutN after decoding gradation depending on each driving nozzle 10. The actuator 91 in the recording head 9 discharges ink droplets based on the image data by opening/closing the analog switch 115.

Figure 5:
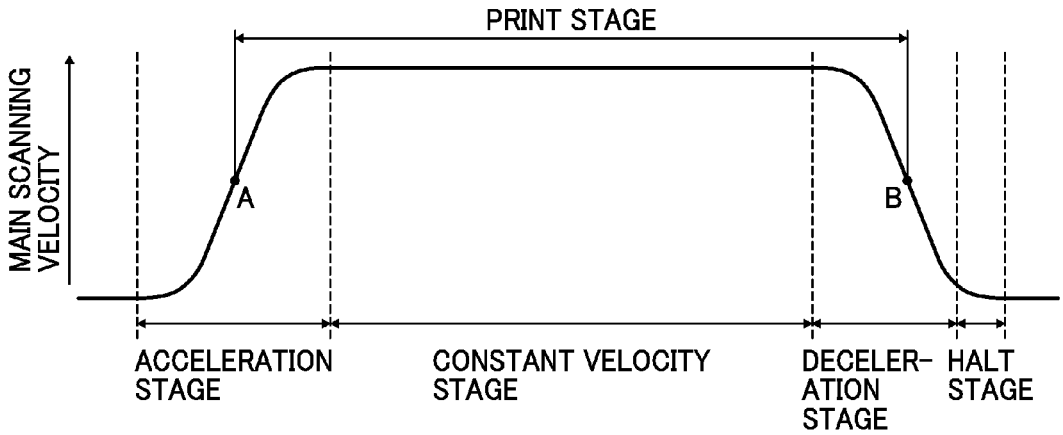
FIG. 5 is a diagram illustrating velocity profile of main scanning in the inkjet recording apparatus as an embodiment of the present invention.

FIG. 5 is a diagram illustrating velocity profile of main scanning in the inkjet recording apparatus.

Main scanning consists of accelerated stage that the carriage 1 accelerates until the carriage 1 reaches constant velocity, constant velocity stage, decelerated stage that the carriage 1 decelerates after the carriage 1 passes position where printing is finished, and halt stage during performing linefeed etc.

In addition, from timing A in the constant velocity stage and the accelerated stage to timing B in the constant velocity stage and the decelerated stage, printing stage that an image is formed on the recording sheet by discharging ink droplets is included. Depending on printing modes, it is determined whether the accelerated stage and the decelerated stage are included in the printing stage or the printing stage consists of the constant velocity stage only.

Figure 6:
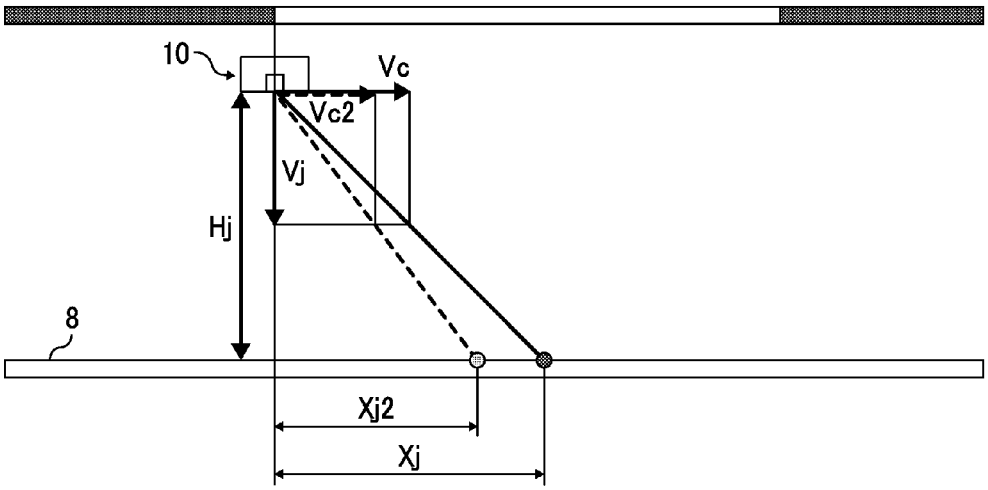
FIG. 6 is a diagram illustrating relationship between moving velocity of the recording head in the main scanning direction and landing positions of ink droplets in the inkjet recording apparatus as an embodiment of the present invention.

FIG. 6 is a diagram illustrating relationship between moving velocity of the recording head 9 in the main scanning direction and landing positions of ink droplets in the inkjet recording apparatus.

In FIG. 6, Vc and Vc2 indicate moving velocity of the carriage 1 in the main scanning direction, Vj indicates discharging velocity of ink droplets from the recording head 9 to the recording medium 8, Hj indicates distance between the recording head 9 and the recording medium 8, and Xj and Xj2 indicate distance between edge of the encoder sheet 5 and the landing position of ink droplets.

If the carriage discharges an ink droplet at the velocity Vj from the recording head 9 with moving at the velocity Vc, the ink droplet lands at the landing position Xj.

The landing position Xj can be calculated using following equation:

$$X_j=(H_j\div V_j)\times V_c \qquad \text{Equation 1}$$

From Equation 1, if the carriage velocity Vc changes to Vc2, the ink droplet landing position Xj also changes to Xj2, and that results in misaligning landing positions.

Similarly, changes of Hj (distance between the recording head and the recording medium) and Vj (discharging velocity of ink droplets from the recording head to the recording medium) also affect the ink droplet landing position Xj.

Figure 7:
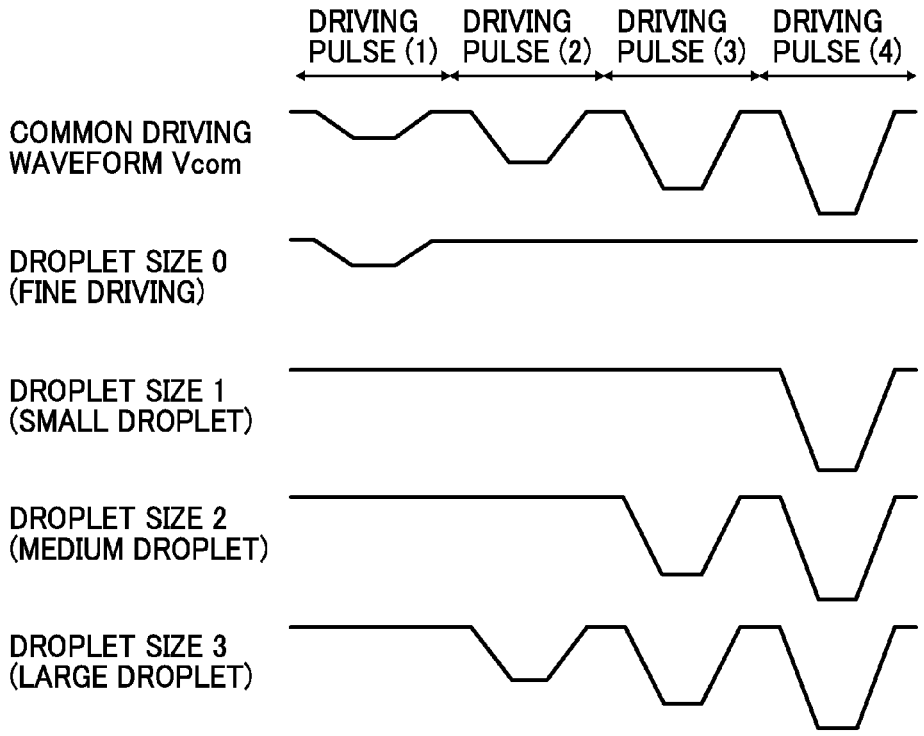
FIG. 7 is a diagram illustrating relationship between driving waveforms and discharged ink droplets as an embodiment of the present invention.

FIG. 7 is a diagram illustrating relationship between driving waveforms and discharged ink droplets.

The common head driving waveform Vcom input into the recording head 9 consists of multiple driving pulses, and sizes of discharged ink droplets corresponding to image data for each nozzle are determined by the combination of the driving pulses. In FIG. 7, the image data is in two bits, and four types of droplet sizes from 0 to 3 can be selected. That is, cases are shown below:

(i) In the case of droplet size 0 (fine driving), driving pulse (1) is output, and the recording nozzle is fine driven (i.e., droplet is not discharged).

(ii) In the case of droplet size 1 (small droplet), driving pulse (4) is output, and small droplet is formed.

(iii) In the case of droplet size 2 (medium droplet), driving pulse (3) and (4) are output, and medium droplet is formed.

(iv) In the case of droplet size 3 (large droplet), driving pulse (2), (3), and (4) are output, and large droplet is formed.

Figures 11, 12:
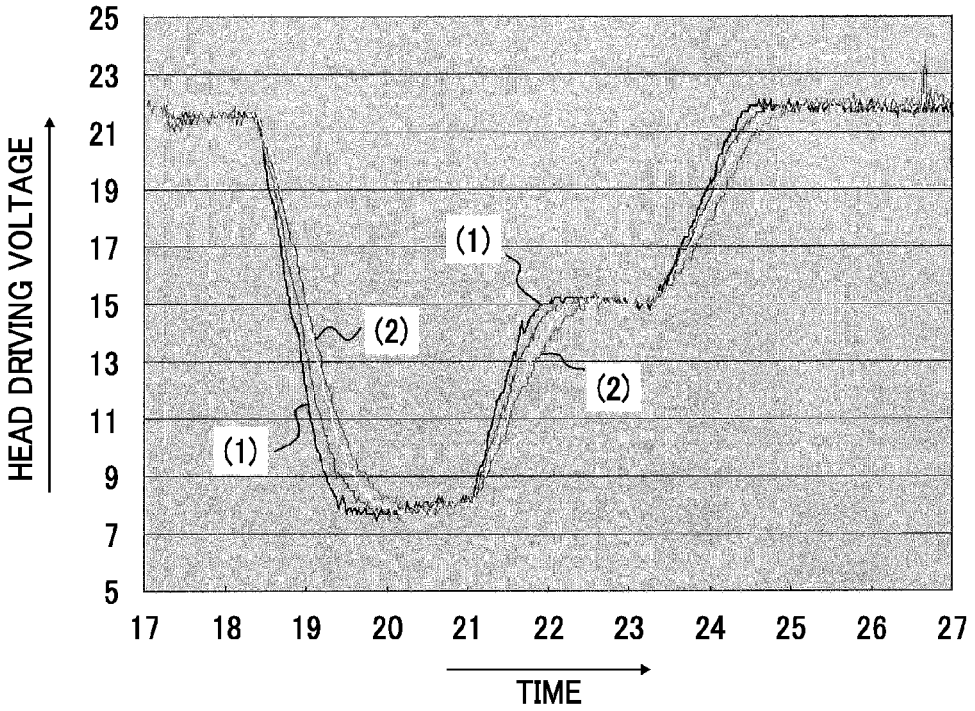
FIG. 11 is a chart illustrating head driving waveforms for the number of driven nozzles that discharge simultaneously, whose vertical axis is head driving voltage and horizontal axis is time as an embodiment of the present invention.
FIG. 12 is a table illustrating relationship between image data and size of discharged droplets as an embodiment of the present invention.

FIG. 12 is a table illustrating relationship between image data and size of discharged droplets. That is, if the image data is in two bits, four types of droplet sizes can be selected.

Regarding upper bit and lower bit of two bits for the image data, if the upper bit is 0 and the lower bit is 0, no droplet is discharged. If the upper bit is 0 and the lower bit is 1, small droplet is discharged. If the upper bit is 1 and the lower bit is 0, medium droplet is discharged. If the upper bit is 1 and the lower bit is 1, large droplet is discharged. Consequently, it is necessary to determine the two bit data to determine the size of droplets.

Figure 8A:
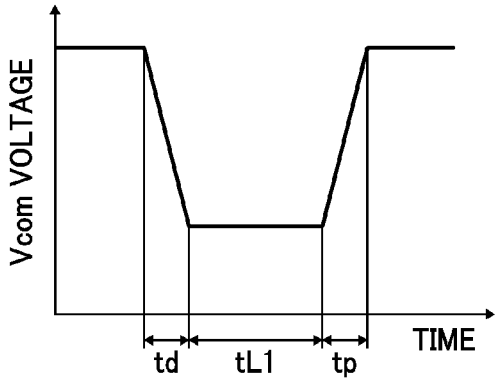
FIGS. 8A and 8B are charts illustrating relationship between the numbers of driven nozzles and driving pulses, whose vertical axis is head driving voltage (Vcom voltage) and horizontal axis is time. The number of driven nozzles is relatively small in FIG. 8A, and the number of driven nozzles is relatively large in FIG. 8B.
Figure 8B:
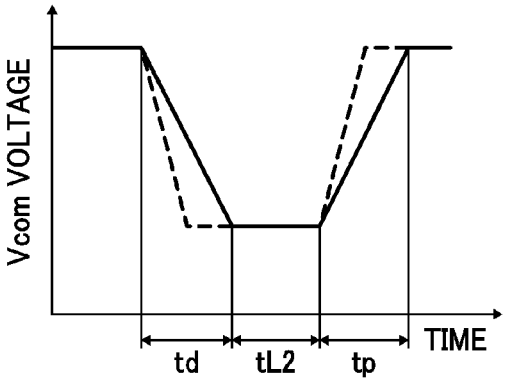

FIGS. 8A and 8B are charts illustrating relationship between the numbers of driven nozzles and driving pulses whose vertical axis is head driving voltage (Vcom voltage) and horizontal axis is time. The number of driven nozzles is relatively small in FIG. 8A, and the number of driven nozzles is relatively large in FIG. 8B.

Load of actuator (capacitance) varies depending on the number of driven nozzles. If the load varies, rising time and fall time of the head driving waveform Vcom vary. If the rising time and the fall time of the head driving waveform Vcom vary, width of low tL of the driving pulse varies. If the width of low of the driving pulse tL varies, discharging velocity Vj of the ink droplet from the recording head to the recording medium varies. If the discharging velocity Vj varies, the landing position Xj of the ink droplets fluctuates as described in FIG. 6, and that results in deteriorating printing quality.

Figure 9:
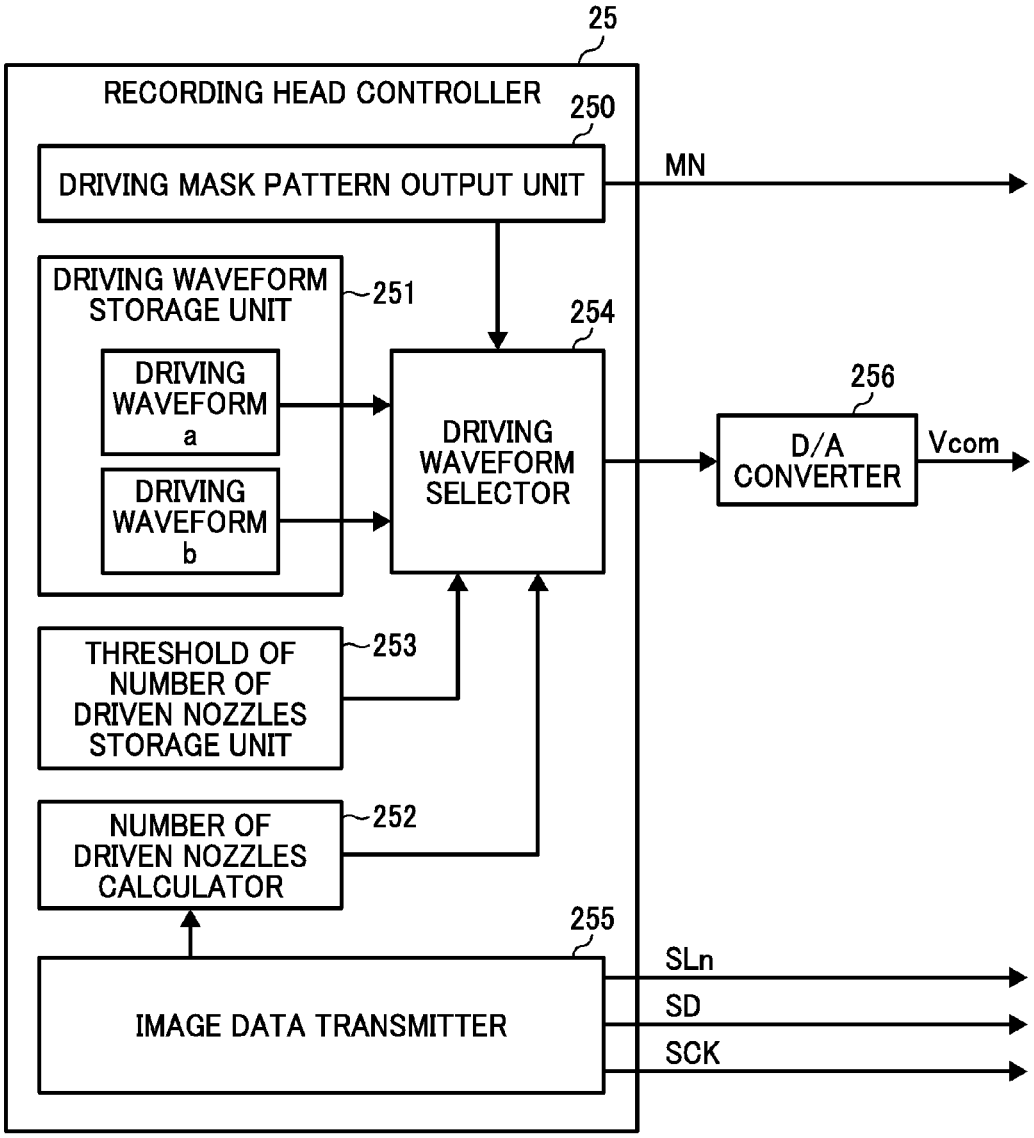
FIG. 9 is a block diagram illustrating a recording head controller in the inkjet recording apparatus as an embodiment of the present invention.

FIG. 9 is a block diagram illustrating the recording head controller 25 in the inkjet recording apparatus. The recording head controller 25 in this embodiment includes a driving waveform storage unit 251 that stores multiple driving waveforms a and b, a number of driven nozzles calculator (calculator) 252 that calculates the number of nozzles driven simultaneously from the image data, a driving waveform selector 254 that selects one driving waveform from multiple driving waveform data based on the number of driven nozzles, and a threshold of number of driven nozzles storage unit 253 used when the driving waveform selector 254 performs selecting. The recording head controller 25 selects the most appropriate driving waveform data in accordance with the number of driven nozzles and outputs it from common driving circuit.

In FIG. 9, two driving waveforms a and b are stored, and either of them are selected and output in accordance with the number of driven nozzles. The number of driven nozzles calculator 252 includes counters for each size of discharged droplets and counts the serial data SD in transferring the image data.

The threshold of the number of driven nozzles storage unit 253 stores at least more than one threshold value, and preferably, that value is variable such as a register configuration.

The driving waveform selector 254 selects one waveform from multiple waveforms a and b stored in the driving waveform storage unit 251 and output it based on the number of driven nozzles sent from the number of driven nozzles calculator 252, threshold of the number of driven nozzles, and information sent from the head driving mask pattern output unit 250.

After being performed digital/analog conversion by the D/A converter 256, the selected driving waveform is input into the recording head driver 11.

Figure 10:
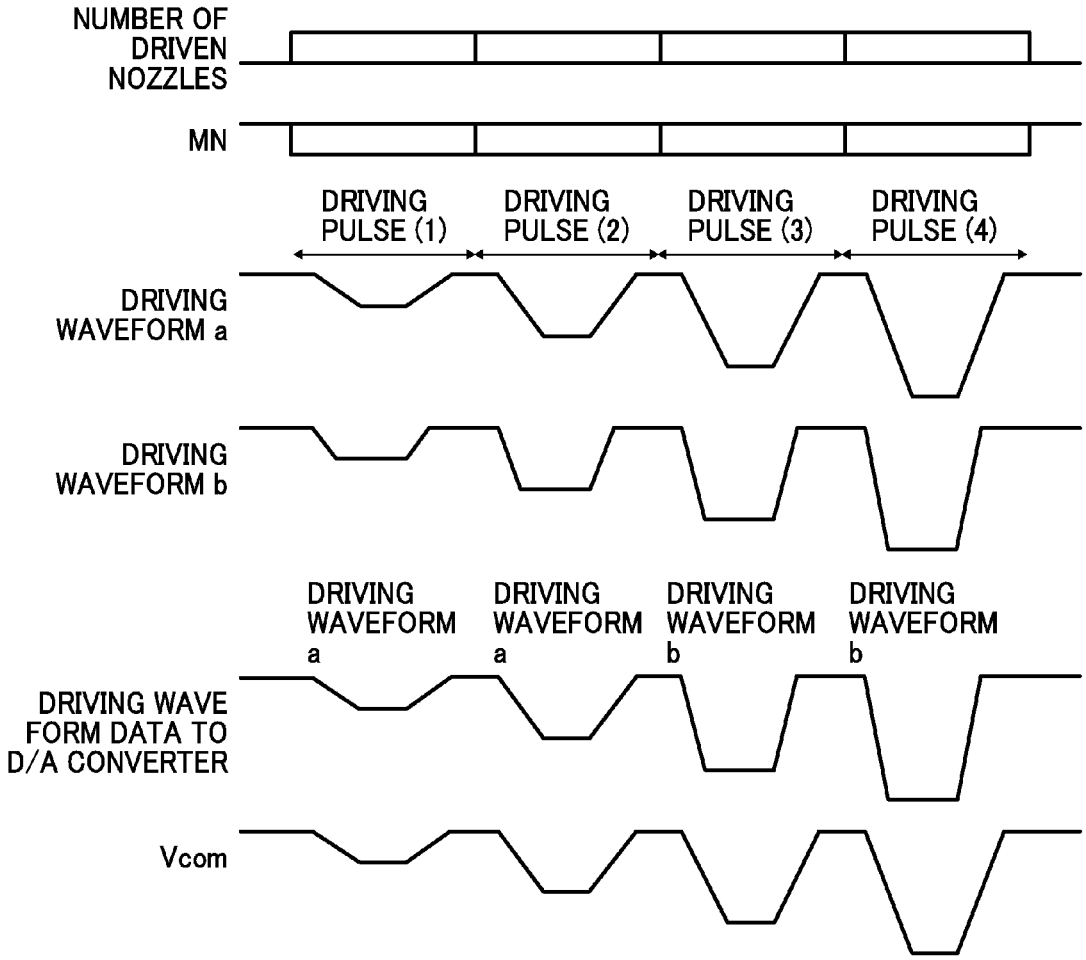
FIG. 10 is a diagram illustrating timing of selecting driving waveform by the recording head controller as an embodiment of the present invention.

FIG. 10 is a diagram illustrating timing of selecting deriving waveform by the recording head controller 25 in this embodiment.

Taking the waveform shown in FIG. 7, the numbers of driven nozzles that affect the rising time and the fall time of the driving waveform pulses are described below:

(i) driving pulse (1): the number of nozzles that is fine driven (ii) driving pulse (2): the number of nozzles that discharge large droplet (iii) driving pulse (3): the number of nozzles that discharge large droplet or medium droplet (iv) driving pulse (4): the number of nozzles that discharge large droplet, medium droplet, or small droplet That is, the numbers of driven nozzles that affect the rising time and the fall time of the driving waveform pulses are different for each of the driving pulses from (1) to (4).

Accordingly, a unit of timing of selecting the driving waveform is preferably a unit of the driving pulse (a unit of one MN period).

In FIG. 10, a driving waveform a is appropriate if the number of driven nozzles is small, and a driving waveform b is appropriate if the number of driven nozzles is large. Both of the driving waveform a and b are stored in the recording head controller 25.

In the driving waveform data appropriate if the number of driven nozzles is large (i.e., the driving waveform b here), for example, the rising time and the fall time of the driving pulse become long (i.e., they become dull) due to the large capacitance. Consequently, with considering this point, the rising time and the fall time of the driving waveform b are set shorter than the driving waveform a preliminarily as shown in FIG. 10.

In FIG. 10, the number of driven nozzles is small in the driving pulses (1) and (2), and in the number of driven nozzles is large in the driving pulses (3) and (4). The driving waveform a is selected in the case of the driving pulses (1) and (2), and the driving waveform b is selected in the case of the driving pulses (3) and (4). Subsequently, the selected waveform is output to the D/A convertor 256. Consequently, in the acquired head driving waveform Vcom, it is possible to reduce the impact of the number of driven nozzles compared to conventional techniques.

The driving waveform is selected by using a table for each of the driving pulses from (1) to (4). A driving waveform selection table is described below.

FIG. 13 is a setting table illustrating a first example configuration of threshold value of the number of driven nozzles.

In FIG. 13, different threshold values for the number of driven nozzles are configured for each driving pulse number (the driving pulses from (1) to (4)). In the left side of the table, threshold values from 100 nozzles to 400 nozzles are configured for each of the driving pulses from (1) to (4). Based on the setting table, in the driving pulses from (1) to (4), the driving waveform a is selected if the number of driven nozzles is less than the threshold value of the number of driven nozzles, and the driving waveform b is selected if the number of driven nozzles is either equal to or larger than the threshold value of the number of driven nozzles.

FIG. 14 is a setting table illustrating a second example configuration of threshold value of the number of driven nozzles.

In the first example of the setting table shown in FIG. 13, if the number of the driving pulses increases, the number of settings of the threshold value of the number of driven nozzles also increases. Therefore, circuit size of the recording head controller 25 becomes redundant than the actual intended number of settings of the threshold value of the number of driven nozzles. Consequently, in the second example configuration shown in FIG. 14, types of the threshold value of the number of driven nozzles indicated not by the driving pulse number but by the combination of droplet sizes realized by the driving waveform data that consists of multiple driving pulses. By configuring different threshold values for each combination, the circuit size of the recording head controller 25 is prevented from becoming large.

For example, if the combination of the target droplet sizes is "large droplet, medium droplet, and small droplet", the threshold value of the number of driven nozzles is set to 700 nozzles. Similarly to the case in FIG. 13, the driving waveform a is selected if the number of driven nozzles is less than the threshold value of the number of driven nozzles, and the driving waveform b is selected if the number of driven nozzles is either equal to or larger than the threshold value of the number of driven nozzles.

FIG. 15 is a setting table illustrating a third example configuration of threshold value of the number of driven nozzles.

In the head driving waveform Vcom, the driving waveform data is different depending on the print mode, and the ink droplet discharging velocity Vj is also different. Taking that point into account, in the third example configuration, different threshold values of the number of driven nozzles can be configured corresponding to the print modes ("high speed, fast, fine, and high quality") preliminarily.

For example, in the case of "high speed", the threshold value of the number of driven nozzles is set to 100 nozzles. Similarly to the cases in FIGS. 13 and 14, the driving waveform a is selected if the number of driven nozzles is less than the threshold value of the number of driven nozzles, and the driving waveform b is selected if the number of driven nozzles is either equal to or larger than the threshold value of the number of driven nozzles.

FIG. 16 is a setting table illustrating a fourth example configuration of threshold value of the number of driven nozzles.

In some cases, the ink droplet discharging velocity varies depending on temperature of the recording head. Taking that point into account, in the fourth example configuration, different threshold values for the number of driven nozzles can be configured corresponding to the detected temperature of the recording head 9.

For example, setting temperature in 10° C. increments, the threshold value of the number of driven nozzles is set to 100 nozzles if the temperature is less than 10° C. Similarly to the cases in FIGS. 13, 14, and 15, the driving waveform a is selected if the number of driven nozzles is less than the threshold value of the number of driven nozzles, and the driving waveform b is selected if the number of driven nozzles is either equal to or larger than the threshold value of the number of driven nozzles.

FIG. 17 is a setting table illustrating a fifth example configuration of threshold value of the number of driven nozzles.

As shown in FIG. 6, the landing position Xj is under the influence of fluctuation of Vc, Vj, and Hj. If the printing stage includes not only the constant velocity stage of the carriage 1 but also the acceleration stage and the deceleration stage, the landing position Xj is corrected by adjusting timing of driving the head basically. However, degree of influence of the ink droplet discharging velocity to the landing position Xj depending on the number of driven nozzles is different in the constant velocity stage, the acceleration stage, and the deceleration stage. Taking that point into account, in the fifth example configuration, different threshold values for the number of driven nozzles can be configured corresponding to the main scanning velocity.

For example, if the main scanning velocity is less than 500 mm/s, the threshold value of the number of driven nozzles is set to 100 nozzles. Similarly to the cases in FIGS. 13, 14, 15, and 16, the driving waveform a is selected if the number of driven nozzles is less than the threshold value of the number of driven nozzles, and the driving waveform b is selected if the number of driven nozzles is either equal to or larger than the threshold value of the number of driven nozzles.

FIG. 18 is a setting table illustrating a sixth example configuration of threshold value of the number of driven nozzles.

In the fifth example configuration shown in FIG. 17, different threshold values for the number of driven nozzles are configured depending on the main scanning velocity. However, even if the main scanning velocity is the same, degree of influence of the ink droplet discharging velocity to the landing position Xj depending on the number of driven nozzles can be different in the acceleration stage and the deceleration stage in some cases. Taking that point into account, in the sixth example configuration, different threshold values for the number of driven nozzles can be configured corresponding to the main scanning positions.

For example, the threshold value of the number of driven nozzles is set to 100 nozzles in the acceleration stage. Similarly to the cases in FIGS. 13, 14, 15, 16, and 17, the driving waveform a is selected if the number of driven nozzles is less than the threshold value of the number of driven nozzles, and the driving waveform b is selected if the number of driven nozzles is either equal to or larger than the threshold value of the number of driven nozzles.

In selecting the driving waveform in cases shown in FIGS. 9 and 10 and FIGS. from 13 to 18, the total number of driven nozzles mounted on all nozzle rows that the recording head 9 includes can be used for that purpose. In addition, the number of driven nozzles mounted on each nozzle row that the recording head 9 includes can be used for that purpose independently.

As described above, in the inkjet recording apparatus in this embodiment, the most appropriate driving waveform output can be realized in accordance with the number of driven nozzles without increasing costs significantly. In addition, the driving waveform can be prevented from becoming unstable due to fluctuation of the recording head load depending on the number of driven nozzles unlike the conventional techniques.

Second Embodiment

Figure 19:
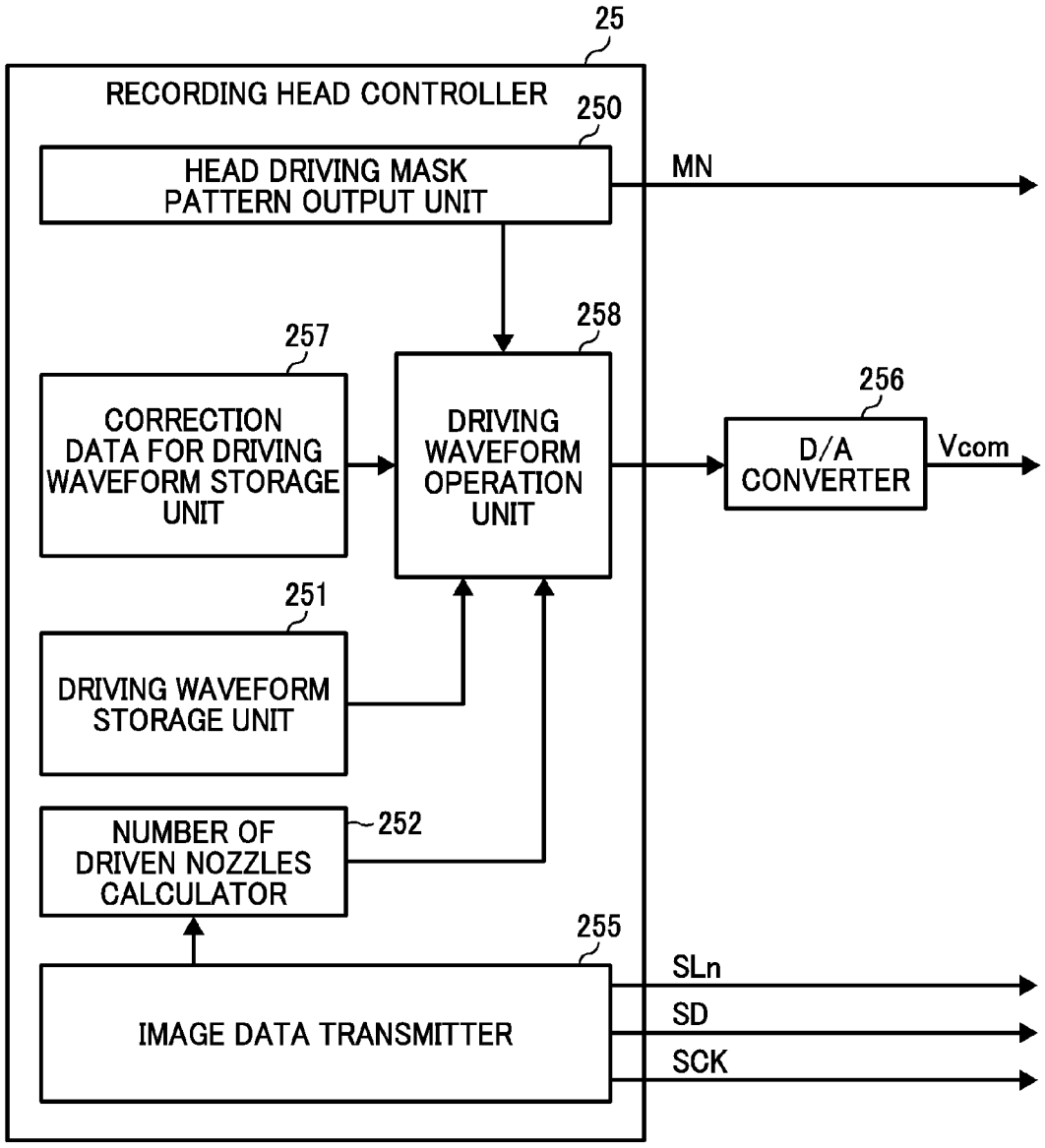
FIG. 19 is a block diagram illustrating an internal configuration of a recording head controller in the inkjet recording apparatus as an embodiment of the present invention.

FIG. 19 is a block diagram illustrating an internal configuration of a recording head controller 25 in the inkjet recording apparatus.

The recording head controller 25 in this embodiment calculates driving waveform data appropriate for the number of driven nozzles and outputs the calculated result to use it for a head driving waveform Vcom by a recording head driver 11 that drives multiple nozzles using a common driving pulse waveform. For that purpose, the recording head controller 25 in this embodiment includes a driving waveform storage unit (first storage unit) 251 that stores standard driving waveform data, a number of driven nozzles calculator 252 that calculates the number of nozzles driven simultaneously from the image data, a correction data for driving waveform storage unit (second storage unit) 257 that stores driving waveform correction data to correct the standard driving waveform data, and a driving waveform calculator 258 as a driving waveform compensator that corrects the standard driving waveform data by using the driving waveform correction data acquired based on the number of driven nozzles. The driving waveform calculator 258 corrects and calculates driving waveform data appropriate for the number of driven nozzles from the standard waveform data and the driving waveform correction data acquired based on the number of driven nozzles and outputs the calculated result to use it for a head driving waveform Vcom. Here, the driving waveform data from which the head driving waveform Vcom is made is generated by correcting operation. However, it is possible to perform the correction by a process other than operation.

An image data transmitter 255 in the recording head controller 25 transfers image data to be recorded stored in the RAM 23 as a print job and passes serial data SD in the image data to the number of driven nozzles calculator 252.

A head driving mask pattern output unit 250 outputs the head driving mask pattern MN to the recording head driver 11.

The standard driving waveform data stored in the driving waveform storage unit 251 is used for generating a driving waveform that can discharge stable ink droplets regardless of the fluctuation in the number of driven nozzles by correcting the standard driving waveform data in accordance with the number of driven nozzles that varies depending on the image data to be recorded. The reason of correcting the standard driving waveform data is to make storage size of driving waveform data prepared in advance in the driving waveform storage unit 251 small.

In the standard driving waveform prepared in this embodiment, the standard driving waveform is stored by memorizing waveform values at each data point assuming generating a driving waveform by reading at predetermined sampling rate. In particular, the standard driving waveform data is a group of waveform values at each data point that digitizes the head driving waveform Vcom shown in FIG. 8A, i.e., a square waveform determined each period by fall time td with constant slope, low width time tL with constant bottom value, and rising time Tp with constant slope.

The method of correcting the standard driving waveform data can also be used for stabilizing discharging the ink droplet for change of condition in operating characteristic of the recording head 9.

In addition, the method of correcting the standard driving waveform data can also make the storage area to store driving waveform data small. Consequently, it is possible to make the size of hardware resources such as storage unit that stores the driving waveform data relatively small.

The standard driving waveform data can be prepared by calculating data that can minimize processing load in correcting data and prevent image quality from deteriorating experimentally and adopting the acquired experiential values.

The number of driven nozzles calculator 252 includes counters for each size of discharged droplets and counts the number of nozzles driven simultaneously based on serial data SD received from the image data transmitter 255 in transferring the image data.

The reason to include the counter for each ink droplet size is because the combination of driving pulses is different depending on the ink droplet sizes (as shown in FIG. 7) and the correct number of nozzles driven simultaneously cannot be acquired without determining the ink droplet size.

The correction data for driving waveform storage unit 257 stores the driving waveform correction data to be used for correcting the standard driving waveform data that stabilizes discharging velocity that becomes unstable in case of keep driving by using the same driving waveform data. The driving waveform correction data includes data such as the correction value used for correcting operation in accordance with the number of driven nozzles performed by the driving waveform calculator 254, applicable condition for the correcting value, and the threshold values of the number of driven nozzles that determines whether or not the correction is necessary (shown in FIGS. from 13 to 18 later). It should be noted that the correction value includes correction coefficient (described later).

Regarding the driving waveform correction data, it is preferable to manage it in the form of a correction table for driving waveform for example so that it is possible to refer to the correction values, applicable condition for the correcting value, and the threshold values of the number of driven nozzles that determines whether or not the correction is necessary associated with the number of driven nozzles and to be able to change values of data and information by setting register etc.

After inputting the number of driven nozzles and the driving waveform correction data managed in the correction table for driving waveform, the driving waveform calculator 258 operates on the standard driving waveform and outputs driving waveform data (digital) appropriate for the number of driven nozzles.

After being digital/analog converted by the D/A converter 256, the operated driving waveform data is input to the recording head driver 11 as the head driving waveform Vcom (analog).

The recording head controller 25 can be constructed by using the computer that consists of components such as the CPU 21, ROM 22, and RAM 23 etc. in the functional block configuration shown in FIG. 2. While it is possible to construct the recording head controller 25 by using a dedicated computer separately, the example configuration that uses the computer shown in FIG. 2 is described below.

In this case, the ROM 22 stores a control program and control data etc. that the CPU 21 uses to control driving of the recording head 9. The RAM 23 is used as memory that stores data etc. generated by the control program temporarily or a work area that stores data necessary for operation of a software program. In addition, nonvolatile memory devices such as NVRAM (not shown in figures) normally included in the computer can be used for storing a part of control data needed to be modified.

If the recording head controller 25 is constructed by the computer, programs including and control data for controlling the recording head driver 11 are installed in the computer via various storage media. The CPU 21 can perform the intended operation by running the installed programs and using the installed control data.

Next, a process of correcting a driving waveform executed by the recording head controller 25 is described below.

FIG. 20 is a flowchart illustrating a process for correcting a driving waveform After receiving a request for outputting a driving waveform from the CPU 21 that accepted a print job, the recording head controller 25 starts the process for correcting the driving waveform shown in FIG. 11.

After starting the process, first, the recording head controller 25 inputs standard driving waveform data to be processed into the driving waveform calculator 254 from the driving waveform storage unit 251 in S101.

The driving waveform data input from the driving waveform storage unit 251 is the standard driving waveform data.

The standard driving waveform data consists of a group of digitized sampling values, that is, waveform values at each data point in the square waveform e.g., shown in FIG. 8A. Therefore, waveform values at series of data points in the square waveform are processed in the driving waveform correction as target of sequential processing.

In addition, the target waveform values to be corrected are in rising period and fall period in the square waveform, and period of low with tL shown in FIG. 8A is not a target to be processed. Therefore, it is necessary to determine whether or not the waveform value currently input is to be corrected. That can be determined by relationship between the input waveform value and waveform value at adjacent data point. Since the waveform value at the adjacent data point is stored in the driving waveform calculator 254 to output it to the recording head driver 11 as the head driving waveform Vcom in the previous process, the stored waveform value at the adjacent data point is used for the determination.

Next, the recording head controller 25 checks whether or not the waveform value currently input is the same as the waveform value at the adjacent data point (stored in the driving waveform calculator 254 already) in S102. After comparing the input waveform value with the waveform value at the adjacent data point, it is determined that they are the same waveform values if the difference of the waveform values does not exceed predefined value. For example, assuming the predetermined value as ±1, it is determined that they are the same waveform values if the absolute value of the difference does not exceed 1. In another case, assuming the past three data points as adjacent data points and subtracting each waveform value from the input waveform value, it can be determined that the waveform values are the same if the difference does not exceed the predetermined value at any of three data points.

By performing the process described above, it is determined whether or not the input waveform value is within the nontarget low width tL period. As in the example case described above, it is determined whether or not the waveform value is within the low width tL period by using the threshold value ±1 on waveform values for three data points. However, the number of waveform values used for that purpose is not limited to three, and the configured threshold value used for that purpose is not limited to ±1. For example, the number of waveform values and the threshold value can be modified arbitrarily by using a register configuration. In that case, the modified configuration values etc. are stored in the correction data for driving waveform storage unit 257.

If it is necessary to set more than a certain period for the low width tL period, it is possible to prepare a configuration value for the low width tL period in the correction data for driving waveform storage unit 257 and assure that period.

In S102, if it is determined that the input waveform value and the waveform value at the adjacent data point are the same and the input waveform value is nontarget (YES in S102), the correction operation is not performed, and the process ends.

Alternatively, after comparing the input waveform value with the waveform values at adjacent three data points, if all of those differences exceed the predetermined value, it is determined that they are not the same waveform values. Accordingly, the waveform value at the input data point is the waveform value in the rising time or the fall time that is the target to be corrected.

In S102, if it is determined that the waveform value at the input data point is not the same as the waveform value at the adjacent data point (NO in S102) and the waveform value at the input data point is the target to be corrected, the correcting operation of the driving waveform appropriate for the number of driven nozzles is performed in S103. The driving waveform calculator 258 performs the correcting operation in S103.

In S103, the driving waveform calculator 258 performs steps from (i) to (iv) shown below as the correcting operation for the driving waveform.

(i) Acquire the Number of Driven Nozzles

The purpose of correcting the driving waveform data is to stabilize the discharging velocity that become unstable due to the fluctuation in the number of nozzles driven simultaneously. Therefore, the number of driven nozzles that the number of driven nozzles calculator 252 calculates from the image data to be processed is acquired as information necessary for correcting.

(ii) Acquire Difference X that Corresponds to the Slope of the Waveform

The rising period and the fall period of the waveform currently input is the target to be corrected, and correction value applied in accordance with the slope of the waveform is configured. Therefore, the difference X between the waveform value at the data point currently input and the waveform value at the adjacent data point (already stored through this operation) is acquired. It should be noted that the difference X can be either plus (+) values or minus (−) values, and the plus values correspond to the rising period, and the minus values correspond to the fall period. In addition, since the difference X has already been calculated in S102, this difference X can be used for that purpose.

(iii) Acquire Correction Data

Subsequent data and information is acquired from the correction data for driving waveform storage unit 257.

In determining whether or not it is necessary to correct in (iv) described below, threshold value of the number of driven nozzles is set, and waveform whose number of driven nozzles is less than the threshold value is eliminated from the target to be corrected. Since the threshold value of the number of driven nozzles is changed in accordance with condition regarding operational characteristic of the recording head 9, the threshold value of the number of driven nozzles is acquired from a table that indicates their correspondence relationship (with reference to FIGS. from 14 to 18 described later) to be applied to the input waveform.

In selecting correction value in accordance with applicable condition in (v) described later, the correction value is modified depending on the number of driven nozzles and waveform in the rising period and the fall period of the driving waveform. Therefore, the correction value applied to the input waveform is acquired from the table that indicates correspondence relationship between the X that corresponds to the number of driven nozzles and the slope of the rising period and the fall period of the waveform and the correction value.

In performing correction operation in (vi) described later, the correction operation is performed by using predetermined operation expression. The predetermined expression is indicated in the acquired table described above in combination with the selected correction value.

(iv) Determine Whether or not it is Necessary to Correct

In this embodiment, the threshold value of the number of driven nozzles is configured to the waveform value to be corrected determined in S102. If the number of driven nozzles is less than the threshold value, the waveform value is eliminated from the correction target since it is difficult to achieve a significant effect of the correction. The threshold value of the number of driven nozzles can be configured in accordance with condition regarding operational characteristic in the recording head 9, and performance can be enhanced much more by modifying the configuration in accordance with the change of the condition.

In determining whether or not it is necessary to correct by using the threshold value of the number of driven nozzles, it is checked whether or not the number of driven nozzles acquired from the number of driven nozzles calculator 252 exceeds threshold value of the number of driven nozzles applied to the waveform to be corrected and acquired from the correction data for driving wave form storage unit 257 (described in (iii) Acquire correction data above). That is, if it does not exceed the threshold value of the number of driven nozzles, it is determined that it is unnecessary to correct, and the waveform value is eliminated from the target to be corrected. Alternatively, if it exceeds the threshold value of the number of driven nozzles, it is determined that it is necessary to correct, and the waveform value is considered as the target to be corrected. it should be noted that an example that modifies the threshold value of the number of driven nozzles depending on the change of condition regarding the operational characteristic of the recording head 9 will be described in detail later with reference to FIGS. from 23 to 27.

(v) Select the Correction Value in Accordance with Applicable Condition

After determining whether or not it is necessary to correct by using the threshold value of the number of driven nozzles, if it is determined that it is necessary to correct, it is necessary to modify the applied correction value in accordance with the changes of the difference X that corresponds to the slope of the waveform and the number of driven nozzles and to configure the correction value that accommodates to those changes.

The accommodating correction value is acquired with reference to a table that associates the number of driven nozzles for the waveform to be corrected and the difference X with the correction values. In the referred table acquired from the correction data for driving waveform storage unit 257, the number of driven nozzles either equal to or larger than the threshold value of the number of driven nozzles is changed at appropriate levels, the difference |X| (absolute value of the difference X) is partitioned at appropriate values in accordance with the changed number of nozzles, and the correction values applied in each zone are associated. The example table will be described in detail later with reference to FIGS. 21 and 22.

(vi) Perform Correcting Operation

Since the waveform values in the rising period and the fall period are targets to be corrected, the driving waveform calculator 258 determines the rising period and the fall period and performs the correcting operation by using the correction value (correction coefficient) configured in accordance with the difference X that corresponds to the number of driven nozzles and the slope of the waveform. Regarding the correction value configured in accordance with the number of driven nozzles and the difference X, the value acquired in (iii) Acquire correction data described above is used for that purpose.

Regarding operational expression for the correcting operation, either multiplication or addition/subtraction can be used for that purpose. Equation 2 uses multiplication of correction coefficient, and Equation 3 uses addition/subtraction of correction value:

$$|\text{N-1th driving waveform data})-(\text{Nth driving waveform data})|\times\text{Correction coeffic} \quad \text{Equation 2}$$

$$|\text{N-1th driving waveform data})-(\text{Nth driving waveform data})|\pm\text{Correction value} \quad \text{Equation 3}$$

In the equations described above, "Nth driving waveform data" is the waveform value at the data point currently input. In addition, "N−1th driving waveform data" is the waveform data at the data point adjacent to the data point currently input and stored in the driving waveform calculator 258 already after performing the correcting operation. Consequently, |(N−1th driving waveform data)−(Nth driving waveform data)| indicates the difference X that corresponds to the slope of the waveform.

The correcting operation is performed using the value calculated by the equations described above. Minus correction is performed on the waveform values in the fall period, and plus correction is performed on the waveform values in the rising period.

Getting back to the flowchart shown in FIG. 20, the driving waveform calculator 258 performs the correcting operation appropriate for the number of driven nozzles and the difference X and corrects the waveform values at the input data point to be corrected (standard driving waveform data) using the acquired value by the correcting operation. Subsequently, the driving waveform calculator 258 outputs the corrected driving waveform data (digital) to the D/A converter 256.

After finishing the correcting operation of the driving waveform data, the process ends.

Here, regarding cycle of correcting the driving waveform in accordance with the flowchart shown in FIG. 11, after being input the corrected driving waveform data, it is the simplest control method to coordinate with conversion cycle of the D/A converter 256 that performs D/A conversion. However, driving pulse cycle of the head driving waveform Vcom (with reference to FIG. 7) that consists of the group of driving pulses from (1) to (4) can be used for that purpose.

In the case of the driving pulse cycle, cycle information is input from the head driving mask pattern output unit 250 (shown in FIG. 19), and each of the driving pulses from (1) to (4) is corrected in the unit of the driving pulse in accordance with the input cycle information.

The number of driven nozzles that is driven simultaneously calculated by the driving nozzle operation unit 258 is used for selecting the correction value for the correcting operation and determining whether or not it is necessary to correct in the process of correcting the driving waveform shown in FIG. 10. Regarding the number of driven nozzles, total number of driven nozzles in all nozzle rows included in the recording head 9 can be used as the number of driven nozzles. Alternatively, the number of driven nozzles in each nozzle row included in the recording head 9 can also be used for that purpose.

Next, a table that indicates correspondence relationship between the number of driven nozzles and the difference X and the correction value stored in the correction data for driving waveform storage unit 257 is described below.

FIG. 21 is a first example of correction table illustrating correction coefficients used for calculation of correcting a driving waveform associated with the number of driven nozzles and difference |X| and correction operational expressions.

In the table shown in FIG. 12, the difference |X| is partitioned at appropriate range in the unit of the number of driven nozzles 100, and applied correction coefficients (correction values) are associated for each partition. The difference |X| corresponds to the slope of the waveform in the rising period and the fall period. As the slope becomes steep, i.e., as the difference |X| gets large, the correction coefficient (%) gets large.

The correction coefficient is the correction value in the case of using the multiplication operational expression (Equation 2 described above) for the correcting operation.

In correcting the driving waveform, the driving waveform data whose difference |X| is less than 1 is out of the target to be corrected, and the driving waveform data whose difference |X| is either equal to or larger than 1 is the target to be corrected.

The number of driven nozzles shown in the table in FIG. 21 is selected using the number of driven nozzles that the number of driven nozzles calculator 252 calculates as the number of nozzles driven simultaneously from the image data to be recorded. Since the scope of the difference |X| is indicated corresponding to the selected number of driven nozzles, the scope that corresponds to the difference |X| of the driving waveform data to be corrected is selected among them, and the correction coefficient that corresponds to the selected difference |X| is selected.

If the interval of the number of driven nozzles in the table shown in FIG. 21 is in 100, the number of driven nozzles can be intermediate values. In that case, it is possible to use values in the table by rounding up etc. or calculate the coefficient by using linear interpolation method. The correcting operation cycle is the same as the converting cycle of the D/A converter 256, and the operation described above is performed each time the driving waveform data is updated.

FIG. 22 is a second example of correction table illustrating correction values used for calculation of correcting a driving waveform associated with the number of driven nozzles and difference |X| and correction operational expressions.

The example table shown in FIG. 22 is basically the same as the table of the first example shown in FIG. 21 except that the correction coefficient is changed to the correction value. That is, the correction value in this second example is used for the correcting operation by Equation 3 with addition/subtraction described above. In the second example, the correction value increases as the difference |X| also increases.

Regarding correction of the driving waveform, the driving waveform data whose difference |X| is less than 1 is nontarget for the correction, and the difference |X| either equal to or larger than 1 is the target for the correction.

The number of driven nozzles in the table shown in FIG. 22 is selected by the number of driven nozzles that the number of driven nozzles calculator 252 calculates as the number of nozzles driven simultaneously from the image data to be recorded. Since ranges of the difference |X| is shown corresponding to the selected number of driven nozzles, the range that corresponds to the difference |X| of the driving waveform data to be corrected is selected among them, and the correction value that corresponds to the selected difference |X| is selected.

If the interval of the number of driven nozzles in the table shown in FIG. 22 is in 100, the number of driven nozzles can be intermediate values. In that case, it is possible to use values in the table by rounding up etc. or calculate the coefficient by using linear interpolation method. The correcting operation cycle is the same as the converting cycle of the D/A converter 256, and the operation described above is performed each time the driving waveform data is updated.

In the first example and second example described above, it is assumed that the waveform during the rising period and the fall period is the target to be corrected, and the waveform during the low width time tL is nontarget.

However, even with the waveform during the rising period and the fall period to be corrected, range of the number of driven nozzles that hardly affects to the discharging operation depending on the condition regarding the operational characteristic of the recording head 9 even if it is excluded from the correcting target exists.

Therefore, in this embodiment, even with the waveform during the rising period and the fall period to be corrected, threshold values of the number of driven nozzles that correspond to each condition regarding the operational characteristic of the recording head 9 are configured, and it is considered as nontarget to be corrected in case of not exceeding the threshold value to enhance performance much more.

As a configuration example of a table stored in the correction data for driving waveform storage unit 257 preliminarily to be used for the correcting operation, a table that includes the threshold value of the number of driven nozzles configured in accordance with the condition regarding the operational characteristic of the recording head 9 is described below.

FIG. 23 is a third example of correction table used for correcting a driving waveform illustrating threshold values of the number of driven nozzles configured for each of driving periods of driving pulses from (1) to (4) that correspond to ink droplet sizes. In FIG. 23, the different threshold values of the number of driven nozzles are configured for each of the driving pulses from (1) to (4). In FIG. 23, in the left side of the table, the threshold values are configured for each of the number of driven nozzles range from 100 to 400 for each of the driving pulses from (1) to (4).

In correcting the driving waveform, the driving waveform data less than the threshold value of the number of driven nozzles shown for each of the driving pulse number is nontarget to be corrected. For example, since the threshold value of the number of driven nozzles is configured as 100 for the driving pulse (2) used for driving the large droplet only, the number of nozzles either equal to or larger than 100 is the target to be corrected.

It is determined whether or not it is necessary to perform the correction with reference to the threshold value of the number of driven nozzles in the correction table shown in FIG. 23 based on the number of driven nozzles that the number of driven nozzles calculator 252 calculates as the number of nozzles driven simultaneously from the image data to be recorded for each of the driving pulses from (1) to (4).

Only if it is determined that it is necessary to perform the correction, the driving waveform is corrected in accordance with the number of driven nozzles. Regarding the method of correcting the waveform, the first example (shown in FIG. 21) or the second example (shown in FIG. 22) can be used for that purpose. Here, to be able to select either of the first example (multiplication) or the second example (addition/subtraction) the selectable method of correcting is indicated in the correction table shown in FIG. 23 as "method of operating driving waveform".

The correcting operation cycle is the same as the converting cycle of the D/A converter 256, and the operation described above can be performed each time the driving waveform data is updated. However, the correcting operation cycle can be the cycle of the driving pulses from (1) to (4). In case of using the cycle of the driving pulses from (1) to (4), the cycle information is input from the head driving mask pattern output unit 250 (shown in FIG. 19), and each of the driving pulses from (1) to (4) is considered as a unit of correcting in accordance with the input cycle information.

FIG. 24 is a fourth example of correction table for correcting the driving waveform illustrating threshold values of the number of driven nozzles configured for each of different print modes. In FIG. 24, different threshold values of the number of driven nozzles are configured corresponding to the print modes ("high speed, fast, fine, and high quality") selected by user operation normally. The printing speed and the image quality are in contradictory relationship, that is, the printing speed becomes low as the image quality becomes high, and the printing speed becomes high as the image quality becomes low. Here, they are selected in four levels. In FIG. 24, in the left side of the table, the threshold values are configured for each of the number of driven nozzles range from 100 to 400 for each of the four printing modes described above. In some cases, the driving waveforms are different depending on the print mode, and it is not limited that the threshold value is stepwise as shown in FIG. 24. Therefore, the threshold values of the number of driven nozzles suitable for each of the printing modes are configured basically.

In correcting the driving waveform, the driving waveform data less than the threshold value of the number of driven nozzles shown for each of the printing modes is nontarget to be corrected. Therefore, for example, since the threshold value of the number of driven nozzles is configured as 200 for the printing mode "fast" in FIG. 24, the number of driven nozzles larger than 200 is the target to be corrected.

Consequently, it is determined whether or not it is necessary to perform the correction with reference to the threshold value of the number of driven nozzles 200 in the correction table shown in FIG. 24 based on the number of driven nozzles that the number of driven nozzles calculator 252 calculates as the number of nozzles driven simultaneously from the image data to be recorded.

Only if it is determined that it is necessary to perform the correction, the driving waveform is corrected in accordance with the number of driven nozzles. Regarding the method of correcting the waveform, the first example (shown in FIG. 21) or the second example (shown in FIG. 22) can be used for that purpose. Here, to be able to select either of the first example (multiplication) or the second example (addition/subtraction) the selectable method of correcting is indicated in the correction table shown in FIG. 24 as "method of operating driving waveform".

The correcting operation cycle is the same as the converting cycle of the D/A converter 256, and the operation described above is performed each time the driving waveform data is updated.

FIG. 25 is a fifth example of correction table for correcting the driving waveform illustrating threshold values of the number of driven nozzles configured for each of different recording head temperature. In FIG. 25, different threshold values of the number of driven nozzles are configured corresponding to temperatures partitioned in 10° C. interval from low temperature to high temperature.

The temperature of the recording head 9 is condition regarding the operational characteristic of the recording head 9, and the discharging velocity varies depending on the temperature of the recording head 9. Therefore, the correction is performed to cope with the temperature change.

In FIG. 25, the threshold values are configured for each of the number of driven nozzles range from 100 to 400 for each of the four ranges of the temperature described above, and it is unnecessary to perform correcting the driving waveform if the number of driven nozzles is less than the threshold value. In the example shown in FIG. 25, the threshold value of driven nozzles increases as the temperature of the recording head 9 rises. In order to determine whether or not it is necessary to correct the driving waveform using the threshold value of the number of driven nozzles configured differently depending on the temperature of the recording head 9, it is necessary to include a sensor that monitors the temperature of the recording head 9 and know the temperature detected by the sensor in performing the correction.

In correcting the driving waveform, the driving waveform data less than the threshold value of the number of driven nozzles shown for each of the recording head temperatures is nontarget to be corrected. For example, if the temperature of the recording head 9 detected by the sensor in correcting is 15° C., since the threshold value of the number of driven nozzles is configured as 200 for the range from 10° C. to 20° C. in FIG. 25, the number of driven nozzles larger than 200 is the target to be corrected in that case.

Consequently, it is determined whether or not it is necessary to perform the correction with reference to the threshold value of the number of driven nozzles 200 in the correction table shown in FIG. 25 based on the number of driven nozzles that the number of driven nozzles calculator 252 calculates as the number of nozzles driven simultaneously from the image data to be recorded.

Only if it is determined that it is necessary to perform the correction, the driving waveform is corrected in accordance with the number of driven nozzles. Regarding the method of correcting the waveform, the first example (shown in FIG. 21) or the second example (shown in FIG. 22) can be used for that purpose. Here, to be able to select either of the first example (multiplication) or the second example (addition/subtraction) the selectable method of correcting is indicated in the correction table shown in FIG. 25 as "method of operating driving waveform".

The correcting operation cycle is the same as the converting cycle of the D/A converter 256, and the operation described above is performed each time the driving waveform data is updated.

FIG. 26 is a sixth example of correction table for correcting a driving waveform illustrating threshold values for the number of driven nozzles configured for each of different main scanning velocities.

As shown in FIG. 6, the landing position Xj is under the influence of fluctuation of Vc, Vj, and Hj. If the printing stage includes not only the constant velocity stage of the carriage 1 but also the acceleration stage and the deceleration stage, the landing position Xj is corrected by adjusting timing of driving the head basically. In addition, degree of influence of the ink droplet discharging velocity to the landing position Xj depending on the number of driven nozzles is different in the constant velocity stage, the acceleration stage, and the deceleration stage. Taking that point into account, in the sixth example configuration, different threshold values of the number of driven nozzles can be configured corresponding to the main scanning velocity.

In FIG. 26, for the ranges of main scanning velocity of the recording head 9, less than 500 mm/s, from 500 mm/s to 700 mm/s, from 700 mm/s to 900 mm/s, and larger than 900 mm/s, the different threshold values for the number of driven nozzles are configured for example.

The main scanning velocity of the recording head 9 is the component velocity of the discharging velocity of the ink droplets, and the discharging velocity varies depending on the main scanning velocity of the recording head 9. Therefore, the correction is performed to cope with the main scanning velocity change.

In FIG. 26, the threshold values are configured for each of the number of driven nozzles range from 100 to 400 for each of the four ranges of the main scanning velocity described above, and it is unnecessary to perform correcting the driving waveform if the number of driven nozzles is less than the threshold value. In the example shown in FIG. 26, the threshold value of driven nozzles increases as the main scanning velocity of the recording head 9 becomes higher. In order to determine whether or not it is necessary to correct the driving waveform using the threshold value of the number of driven nozzles configured differently depending on the main scanning velocity of the recording head 9, it is necessary to acquire the main scanning velocity of the recording head 9. The main scanning velocity of the recording head 9 can be acquired from velocity profile configured in controlling velocity.

In correcting the driving waveform, the driving waveform data less than the threshold value of the number of driven nozzles shown for each of the main scanning velocity of the recording head 9 is nontarget to be corrected. For example, if the main scanning velocity of the recording head 9 acquired from the velocity profile in correcting is 800 mm/s, since the threshold value of the number of driven nozzles is configured as 300 for the range from 700 mm/s to 900 mm/s in FIG. 26, the number of driven nozzles larger than 300 is the target to be corrected in that case.

Consequently, it is determined whether or not it is necessary to perform the correction with reference to the threshold value of the number of driven nozzles 300 in the correction table shown in FIG. 26 based on the number of driven nozzles that the number of driven nozzles calculator 252 calculates as the number of nozzles driven simultaneously from the image data to be recorded.

Only if it is determined that it is necessary to perform the correction, the driving waveform is corrected in accordance with the number of driven nozzles. Regarding the method of correcting the waveform, the first example (shown in FIG. 21) or the second example (shown in FIG. 22) can be used for that purpose. Here, to be able to select either of the first example (multiplication) or the second example (addition/subtraction) the selectable method of correcting is indicated in the correction table shown in FIG. 26 as "method of operating driving waveform".

The correcting operation cycle is the same as the converting cycle of the D/A converter 256, and the operation described above is performed each time the driving waveform data is updated.

Figures 27, 28A, 28B:
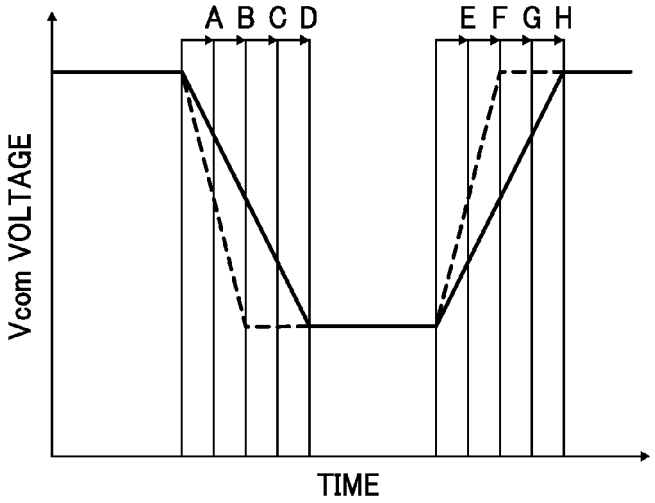
FIG. 27 is a seventh example of correction table for correcting a driving waveform illustrating threshold values for the number of driven nozzles configured for each of different main scanning positions as an embodiment of the present invention.
FIG. 28A is a chart and FIG. 28B is a table illustrating correction values that correspond to each of periods A-D and E-H in a head driving waveform (Vcom voltage) as an embodiment of the present invention.

FIG. 27 is a seventh example of correction table for correcting a driving waveform illustrating threshold values for the number of driven nozzles configured for each of different main scanning positions.

In the sixth example described above with reference to the correction table shown in FIG. 17, the different threshold values of the number of driven nozzles are configured depending on the main scanning velocity of the recording head 9. However, even if the main scanning velocity is the same, degree of influence of the ink droplet discharging velocity to the landing position Xj depending on the number of driven nozzles can be different between the acceleration stage and the deceleration stage (shown in FIG. 5) in some cases. Taking that point into account, in the seventh example configuration, different threshold values of the number of driven nozzles can be configured corresponding to the main scanning position.

In FIG. 27, for each of the three stages of the main scanning position of the recording head 9, the acceleration stage, the constant velocity stage, and the deceleration stage, the different threshold values for the number of driven nozzles are configured for example.

In FIG. 27, the threshold values 100, 300, and 200 are configured for each of the acceleration stage, the constant velocity stage, and the deceleration stage, and it is unnecessary to perform correcting the driving waveform if the number of driven nozzles is less than the threshold value. In order to determine whether or not it is necessary to correct the driving waveform using the threshold value of the number of driven nozzles configured differently depending on the main scanning position of the recording head 9, it is necessary to acquire the main scanning position of the recording head 9. The main scanning position of the recording head 9 in the acceleration stage, the constant velocity stage, and the deceleration stage can be acquired from control information in controlling velocity in accordance with the velocity profile.

In correcting the driving waveform, the driving waveform data less than the threshold value of the number of driven nozzles shown for each of the main scanning velocity of the recording head 9 is nontarget to be corrected. For example, if the main scanning position of the recording head 9 acquired in controlling velocity in accordance with the velocity profile is deceleration stage, since the threshold value of the number of driven nozzles is configured as 200 for the deceleration stage in FIG. 27, the number of driven nozzles larger than 200 is the target to be corrected in that case.

Consequently, it is determined whether or not it is necessary to perform the correction with reference to the threshold value of the number of driven nozzles 200 in the correction table shown in FIG. 27 based on the number of driven nozzles that the number of driven nozzles calculator 252 calculates as the number of nozzles driven simultaneously from the image data to be recorded.

Only if it is determined that it is necessary to perform the correction, the driving waveform is corrected in accordance with the number of driven nozzles. Regarding the method of correcting the waveform, the first example (shown in FIG. 21) or the second example (shown in FIG. 22) can be used for that purpose. Here, to be able to select either of the first example (multiplication) or the second example (addition/subtraction) the selectable method of correcting is indicated in the correction table shown in FIG. 27 as "method of operating driving waveform".

The correcting operation cycle is the same as the converting cycle of the D/A converter 256, and the operation described above is performed each time the driving waveform data is updated.

Next, another method of correcting the driving waveform is described below.

In the method of correcting the driving waveform described above, the standard driving waveform data is corrected using the number of driven nozzles and the difference |X| that corresponds to the slope of the waveform acquired from the correction table in the first example (shown in FIG. 21) and the second example (shown in FIG. 22) (hereinafter referred to as "standard correcting method").

However, in the standard correcting method, the value calculated using Equation 2 or Equation 3 described above with the correction value selected from the correction table does not change if the number of driven nozzles and the difference |X| that corresponds to the slope of the waveform. Therefore, the value deviates from expectation value (with reference to FIGS. 28A and 28B).

To cope with this issue, additional correction is performed to make the deviation small.

Assuming that the waveform of the driving pulse waveform to be corrected during the rising period and the fall period has linear characteristic, in this additional correction, correction value is added to the values calculated by the standard correcting method described above at each data point of the driving waveform.

FIG. 28A is a chart and FIG. 28B is a table illustrating correction values that correspond to each of periods A, B, C, and D and E, F, G, and H in a head driving waveform (Vcom voltage).

In FIG. 28A, in the head driving waveform (Vcom voltage), the fall period with constant slop is partitioned to the periods A, B, C, and D with series of data points whose time interval is constant, and the rising period with constant slop is partitioned to the periods E, F, G, and H with series of data points whose time interval is constant.

In FIG. 28A, each of the periods A, B, C, and D is successive, and each period of the periods A, B, C, and D is determined by the number of consecutive waveforms whose slope is the same from the period A. The correction values (α) that correspond to each of the periods A, B, C, and D are shown in the table in FIG. 28B with minus sign. Similarly, the additional correction values (α) that correspond to each of the periods E, F, G, and H are shown in the table in FIG. 28B with plus sign The correction values in the correction value (α) table makes the deviation that cannot be coped with the correction value in accordance with the difference |x| and the number of the driven nozzles at data points of the driving waveform using the standard correcting method described above small.

The table shown in FIG. 28B is stored in the correction data for driving waveform storage unit 257 (shown in FIG. 19).

Here, the above deviation is described below with reference to FIGS. 28A and 28B. The absolute values of the slopes in both the periods A, B, C, and D (fall edge, minus) and the periods E, F, G, and H (rising edge, plus) are the same in FIG. 28A. Broken lines in FIG. 28A indicates expectation value, and solid lines in FIG. 28A indicates the driving waveform actually output. That is, if the number of driven nozzles is small, there is no deviation from the expectation value indicated by the broken lines, and it is possible to perform intended discharging operation by using this driving waveform. By contrast, the standard correcting method that performs the correction suitable for the standard driving waveform data, the number of driven nozzles, and the difference |X| at each data point results in the waveform indicated by the solid lines, and the deviation from the broken lines occurs.

As shown in FIG. 28A, the deviation between the expected driving waveform data and the actual driving waveform data increases as the consecutive periods pass from A to D and from E to H.

In case of successive waveform data whose slope is the same, i.e., driving waveform data that has linear characteristic, it is possible to make the deviation smaller by performing the correction using "the correction value+α" (i.e., the correction value by the standard correcting method described above+the additional correction value α).

In particular, if the expected driving waveform data in the periods A, B, C, and D is 100→90→80→70, the actual driving waveform is like 100→95→90→85. In this case, by performing the correction using "the correction value+α" that makes the deviation from the expectation value small, considering the correction value 5 as the reference value, in accordance with the successive number of consecutive periods B→C→D (F→G→H), the correction that takes easiness of the waveform into account by adding the correction value (α) in the table shown in FIG. 28B. That is, a process like 100 (correction value:0, α:0)→95 (correction value:5, α:0)→90 (correction value:5, α:5)→85 (correction value:5, α:10) that performs an operation "correction value+α" shown in parentheses on the actual driving waveform 100→95→90→85. Consequently, the driving waveform data 100→90→80→70 as the expectation value is acquired, and the deviation between the expected driving waveform data and the actual driving waveform data can be made lesser.

Third Embodiment

FIGS. 8A and 8B are charts illustrating relationship between the numbers of driven nozzles and driving pulses whose vertical axis is head driving voltage (Vcom voltage) and horizontal axis is time. The number of driven nozzles is relatively small in FIG. 8A, and the number of driven nozzles is relatively large in FIG. 8B.

Load of actuator 91 (capacitance) varies depending on the number of driven nozzles. If the load varies, rising time tp and fall time td of the head driving waveform Vcom vary. If the rising time tp and the fall time td of the head driving waveform Vcom vary, width of low tL (tL1 and tL2) of the driving pulse vary. If the width of low of the driving pulse tL (tL1 and tL2) vary, discharging velocity Vj of the ink droplet from the recording head 9 to the recording medium 8 varies. If the discharging velocity Vj varies, the landing position Xj of the ink droplets fluctuates as described in FIG. 6, and that results in deteriorating printing quality.

That is, due to the change of the number of nozzles 10 driven simultaneously, the rising time tp, the fall time td, and the width of low of the driving pulse vary. That is, the driving waveform Vcom that consists of the group of multiple driving pulses varies, and that results in deteriorating printing quality.

In this embodiment, both the issue described above and a problem to minimize the increase of hardware resource such as memory capacity and an arithmetic circuit are solved at the same time. For that purpose, here, timing of transferring the driving waveform to the D/A convertor 30 connected to the recording head controller 25 is corrected using delay data in accordance with the number of nozzles 10 driven simultaneously (delay correction). Accordingly, D/A converting cycle of each driving pulse in the D/A convertor 30 is corrected, and that can minimize the fluctuation in the driving waveform that consists of the group of driving pulses. The delay data can be both plus (extension) and minus (reduction).

Figure 29:
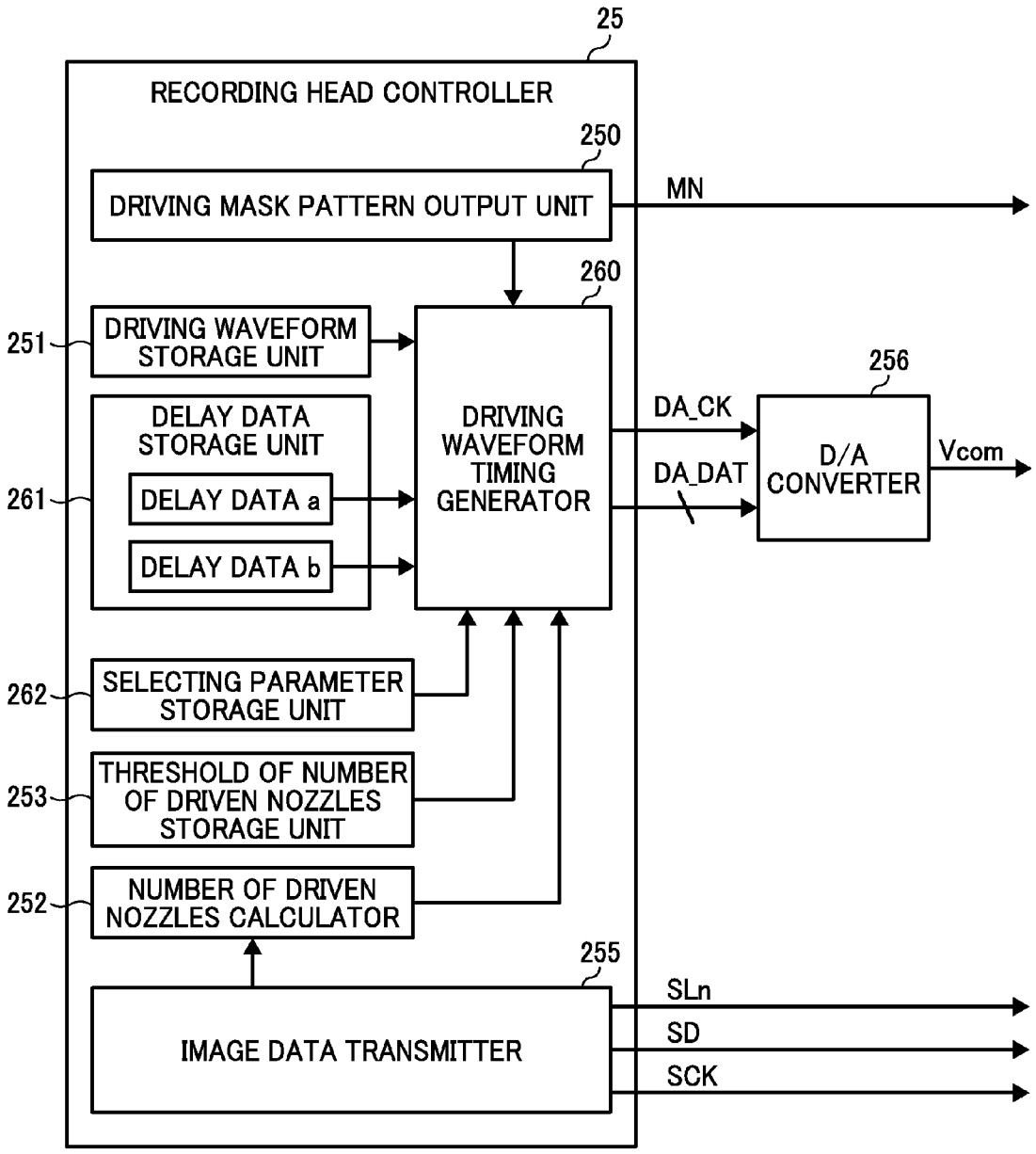
FIG. 29 is a block diagram illustrating an internal configuration of a recording head controller in the inkjet recording apparatus as an embodiment of the present invention.

FIG. 29 is a block diagram illustrating the recording head controller 25 in the image recording apparatus in this embodiment. The recording head controller 25 in this embodiment includes a driving mask pattern output unit 250, a driving waveform timing generator 260 that selects one delay data from multiple delay data based on the number of driven nozzles, a driving waveform storage unit 251 that stores driving waveform data, a delay data storage unit 261 that stores multiple delay data, a selecting parameter storage unit 262, a threshold of number of driven nozzles storage unit 253, a number of driven nozzles calculator 252 that calculates the number of nozzles driven simultaneously from the image data, and an image data transmitter 255. The recording head controller 25 is connected to a D/A converter 256.

The driving waveform timing generator 260 selects the most appropriate delay data in accordance with the number of driven nozzles based on the threshold value of the number of driven nozzles used for selecting the delay data and outputs the selected delay data from the common driving circuit.

In FIG. 29, the delay data storage unit 261 stores two types of delay data (delay correction table) a and b.

The driving waveform timing generator 260 selects one delay data from multiple delay data a and b stored in the delay data storage unit 261 based on the number of driven nozzles acquired from the number of driven nozzles calculator, the threshold value of the number of driven nozzles, and information from the driving mask pattern output unit 250. The driving waveform timing generator 260 corrects the timing of transferring the driving waveform data (digital data:

DA_DAT signal) to the D/A convertor 256 (periodic fluctuation of the driving waveform) based on the selected delay data a or b.

The number of driven nozzles calculator 252 includes counters for each size of discharged droplets and counts the number of nozzles driven simultaneously from the image data (serial data) SD in transferring the image data.

The threshold of the number of driven nozzles storage unit 253 stores at least more than one threshold value, and preferably, that value is variable such as a register configuration.

Next, correction of the timing of transferring the driving waveform data by the driving waveform timing generator is described below.

Figure 30:
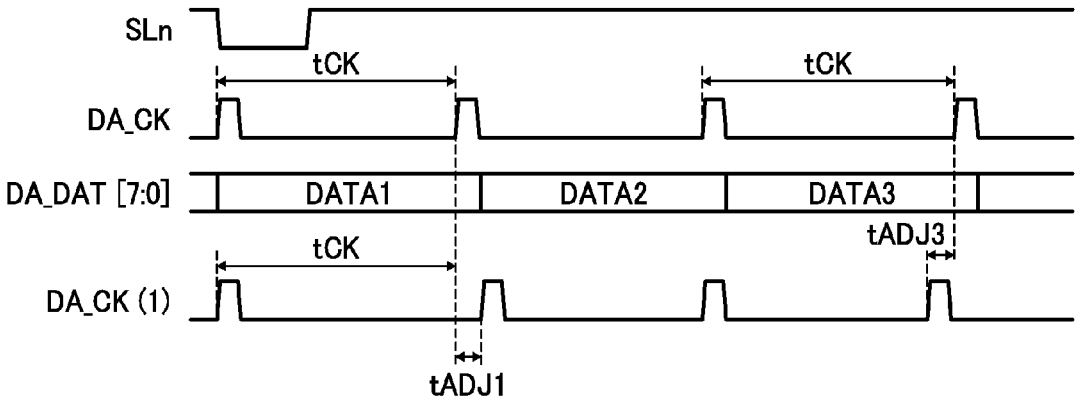
FIG. 30 is a timing chart illustrating timing of an interface in a D/A convertor as an embodiment of the present invention.

FIG. 30 is a timing chart illustrating timing of the interface in the D/A convertor 256.

For example, the D/A convertor 256 in this embodiment fetches DA_DAT signal at the rising edge of DA_CK signal (a clock signal for transferring driving waveform data DA_DAT signal) and outputs the driving waveform (Vcom) converted to an analog signal at the next rising edge of DA_CK signal. That is, the D/A convertor 256 converts the received driving waveform as the digital signal into the driving waveform (Vcom) as the analog signal.

DA_CK(1) signal in FIG. 30 indicates a case in which the timing of transferring the driving waveform data (DA_DAT) signal is corrected.

The driving waveform data (DA_DAT signal) stored in the delay data storage unit 261 is generated assuming that the D/A converting cycle tCL is constant for each of the multiple driving pulses that consist of the driving waveform data stored in the delay data storage unit 261. The delay data a and b described above are delay amount for the D/A converting cycle tCK.

In FIG. 30, the delayed time by the delay data against the D/A converting cycle of the first driving pulse is tADJ1. Similarly, tADJ3 indicates a case in which the delay data is a minus value. In this case, the converting cycle becomes shorter for tADJ3. In this way, whole length of the driving waveform (Vcom) does not change by taking a minus value for the delay data too.

If it is unnecessary to perform the correction, the driving waveform (data) Vcom becomes equivalent to the driving waveform (data) stored in the driving waveform storage unit 251 by making all delay amount 0.

In case of performing the delay correction, the driving waveform data DA_DAT signal also delays just like the clock DA_CK signal.

As described above, in the recording head controller 25, one delay data is selected from the stored delay data based on the number of nozzles driven simultaneously. The timing of driving waveform for correcting the timing of transferring the driving waveform to the D/A convertor based on the selected delay data, and the timing of transferring the driving waveform data to the D/A convertor based on the selected delay data is corrected. In addition, the D/A converting cycle in the D/A converter is modified by correcting the timing of transferring the driving waveform data, and the fluctuation of the driving waveform due to the fluctuation of the number of nozzles driven simultaneously is minimized. The units that perform steps described above such as the driving waveform timing generator 260 can be realized by executing a program by the computer in the inkjet recording apparatus.

Figure 31:
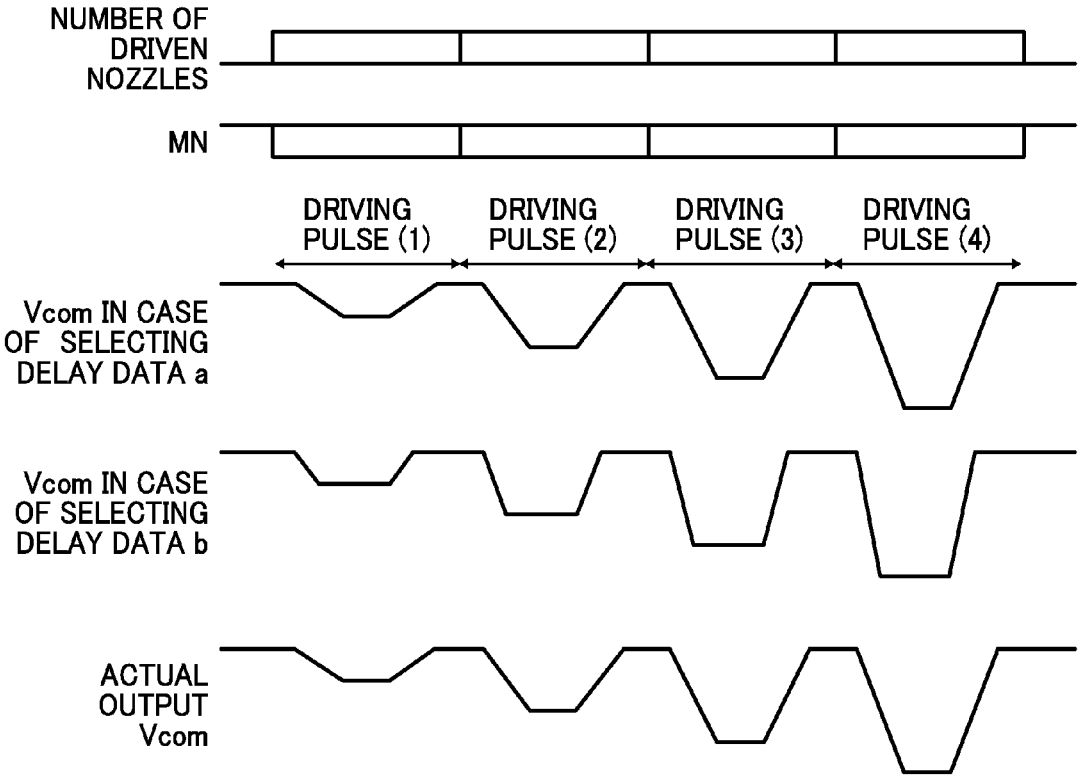
FIG. 31 is a diagram illustrating timing of selecting delay data by the recording head controller as an embodiment of the present invention.

FIG. 31 is a diagram illustrating timing of selecting delay data by the recording head controller 25 in this embodiment.

Taking the waveform shown in FIG. 7, the numbers of driven nozzles that affect the rising time and the fall time of the driving waveform pulses are described below:

(i) driving pulse (1): the number of nozzles that is fine driven (ii) driving pulse (2): the number of nozzles that discharge large droplet (iii) driving pulse (3): the number of nozzles that discharge large droplet or medium droplet (iv) driving pulse (4): the number of nozzles that discharge large droplet, medium droplet, or small droplet That is, the numbers of driven nozzles that affect the rising time and the fall time of the driving waveform pulses are different for each of the driving pulses from (1) to (4).

Accordingly, a unit of timing of selecting the driving waveform is preferably a unit of the driving pulse (a unit of one MN period).

In FIG. 31, delay data a is appropriate if the number of driven nozzles is small, and delay data b is appropriate if the number of driven nozzles is large.

Here, in the delay data b appropriate if the number of driven nozzles is large, for example, the rising time and the fall time of the driving pulse become long (i.e., they become dull) due to the large capacitance. Consequently, with considering this point, the delay data b is used for correcting the timing of transferring the driving waveform data to the D/A converter 256 preliminarily so that the rising period and the fall period of the driving pulse become shorter.

In FIG. 31, the number of driven nozzles is small in the driving pulses (1) and (2), and in the number of driven nozzles is large in the driving pulses (3) and (4). The delay data a is selected in the case of the driving pulses (1) and (2), and the delay data b is selected in the case of the driving pulses (3) and (4). Subsequently, after correcting the driving waveform (data) to minimize the fluctuation based on the selected delay data a or b, the corrected driving waveform (data) is output to the D/A convertor 256. Consequently, in the acquired head driving waveform Vcom for the recording head 9, it is possible to reduce the impact of the number of driven nozzles compared to conventional techniques.

Here, since the delay data is selected in the unit of the driving pulse (unit of 1 MN period), it is preferable that the grand total of the delay data a is the same as the grand total of the delay data b.

FIG. 32 is a setting table illustrating a first example configuration of threshold value of the number of driven nozzles In FIG. 32, different threshold values for the number of driven nozzles are configured for each driving pulse number (the driving pulses from (1) to (4)). That is, the threshold value of the driving pulse (1) is 400 nozzles, the threshold value of the driving pulse (2) is 100 nozzles, the threshold value of the driving pulse (3) is 200 nozzles, and the threshold value of the driving pulse (4) is 300 nozzles.

In addition, in the driving pulses from (1) to (4), the delay data a is selected if the number of driven nozzles is less than the threshold value of the number of driven nozzles, and the delay data b is selected if the number of driven nozzles is either equal to or larger than the threshold value of the number of driven nozzles.

FIG. 33 is a setting table illustrating a second example configuration of threshold value of the number of driven nozzles.

In the first example of the setting table shown in FIG. 32, if the number of the driving pulses increases, the number of settings of the threshold value of the number of driven nozzles also increases. Therefore, circuit size of the recording head controller 25 becomes redundant than the actual intended number of settings of the threshold value of the number of driven nozzles. Consequently, in the second example configuration shown in FIG. 33, types of the threshold value of the number of driven nozzles indicated not by the driving pulse number but by the combination of droplet sizes realized by the driving waveform data that consists of multiple driving pulses. By configuring different threshold values for each combination, the circuit size of the recording head controller 25 is prevented from becoming large.

Here, in a unit of mask signal values of the driving pulse, the target droplet sizes are categorized as (i) large droplet, medium droplet, and small droplet, (ii) large droplet and medium droplet, (iii) large droplet and small droplet, (iv) large droplet, (v) medium droplet and small droplet, (vi) medium droplet, and (vii) small droplet. On that basis, the threshold values are configured for each of the droplet sizes.

That is, in the case of (i) large droplet, medium droplet, and small droplet, the threshold value of the number of driven nozzles is set to 700 nozzles. In the case of (ii) large droplet and medium droplet, the threshold value of the number of driven nozzles is set to 600. In the case of (iii) large droplet and small droplet, the threshold value of the number of driven nozzles is set to 400. In the case of (iv) large droplet, the threshold value of the number of driven nozzles is set to 300. In the case of (v) medium droplet and small droplet, the threshold value of the number of driven nozzles is set to 500. In the case of (vi) medium droplet, the threshold value of the number of driven nozzles is set to 200. In the case of (vii) small droplet, the threshold value of the number of driven nozzles is set to 100.

Similarly to the case in FIG. 32, the delay data a is selected if the number of driven nozzles is less than the threshold value of the number of driven nozzles, and the delay data b is selected if the number of driven nozzles is either equal to or larger than the threshold value of the number of driven nozzles.

FIG. 34 is a setting table illustrating a third example configuration of threshold value of the number of driven nozzles.

In the head driving waveform Vcom, the driving waveform data is different depending on the print mode, and the ink droplet discharging velocity Vj is also different. Taking that point into account, in the third example configuration, different threshold values of the number of driven nozzles can be configured corresponding to the print modes As shown in FIG. 34, here, the printing modes are categorized as (i) high speed, (ii) fast, (iii) fine, and (iv) high quality. In the case of (i) high speed, the threshold value of the number of driven nozzles is set to 100 nozzles. In the case of (ii) fast, the threshold value of the number of driven nozzles is set to 200 nozzles. In the case of (iii) fine, the threshold value of the number of driven nozzles is set to 300 nozzles. In the case of (iv) high quality, the threshold value of the number of driven nozzles is set to 400 nozzles.

Similarly to the cases in FIGS. 32 and 33, the delay data a is selected if the number of driven nozzles is less than the threshold value of the number of driven nozzles, and the delay data b is selected if the number of driven nozzles is either equal to or larger than the threshold value of the number of driven nozzles.

FIG. 35 is a setting table illustrating a fourth example configuration of threshold value of the number of driven nozzles.

In some cases, the ink droplet discharging velocity varies depending on temperature of the recording head 9. Taking that point into account, in the fourth example configuration, different threshold values for the number of driven nozzles can be configured corresponding to the detected temperature of the recording head 9.

In this fourth example, the temperature of the recording head 9 is categorized as (i) less than 10° C., (ii) either equal to or more than 10° C. and less than 20° C., (iii) either equal to or more than 20° C. and less than 30° C., and (iv) either equal to or more than 30° C. The number of categories can be modified.

Here, in the case of (i) less than 10° C., the threshold value of the number of driven nozzles is set to 100 nozzles. In the case of (ii) either equal to or more than 10° C. and less than 20° C., the threshold value of the number of driven nozzles is set to 200 nozzles. In the case of (iii) either equal to or more than 20° C. and less than 30° C., the threshold value of the number of driven nozzles is set to 300 nozzles. In the case of (iv) either equal to or more than 30° C., the threshold value of the number of driven nozzles is set to 400 nozzles. zzles is set to 100 nozzles if the temperature is less than 10° C.

Similarly to the cases in FIGS. 32, 33, and 34, the delay data a is selected if the number of driven nozzles is less than the threshold value of the number of driven nozzles, and the delay data b is selected if the number of driven nozzles is either equal to or larger than the threshold value of the number of driven nozzles.

FIG. 36 is a setting table illustrating a fifth example configuration of threshold value of the number of driven nozzles.

As shown in FIG. 6, the landing position Xj (distance from the edge of the encoder sheet 5 to the landing position of the ink droplet) is under the influence of fluctuation of Vc (the moving velocity of the carriage 1 in the main scanning direction), Vj (discharging velocity of the ink droplet from the recording head 9 to the recording medium 8), and Hj (distance between the recording head 9 to the recording medium 8).

If the printing stage includes not only the constant velocity stage of the carriage 1 but also the acceleration stage and the deceleration stage, the landing position Xj is corrected by adjusting timing of driving the head basically. In this case, degree of influence of the ink droplet discharging velocity to the landing position Xj depending on the number of driven nozzles is different in the constant velocity stage, the acceleration stage, and the deceleration stage.

Taking that point into account, in the fifth example configuration, different threshold values for the number of driven nozzles can be configured corresponding to the main scanning velocity.

In FIG. 36, in this fifth example, the main scanning velocity is categorized as (i) less than 500 mm/s, (ii) either equal to or more than 500 mm/s and less than 700 mm/s, (iii) either equal to or more than 700 mm/s and less than 900 mm/s, and (iv) either equal to or more than 900 mm/s, and the threshold values of the number of driven nozzles are configured for each category. That is, in the case of (i) less than 500 mm/s, the threshold value of the number of driven nozzles is set to 100 nozzles. In the case of (ii) either equal to or more than 500 mm/s and less than 700 mm/s, the threshold value of the number of driven nozzles is set to 200 nozzles. In the case of (iii) either equal to or more than 700 mm/s and less than 900 mm/s, the threshold value of the number of driven nozzles is set to 300 nozzles. In the case of (iv) either equal to or more than 900 mm/s, the threshold value of the number of driven nozzles is set to 400 nozzles.

Similarly to the cases in FIGS. 32, 33, 34, and 35, the delay data a is selected if the number of driven nozzles is less than the threshold value of the number of driven nozzles, and the delay data b is selected if the number of driven nozzles is either equal to or larger than the threshold value of the number of driven nozzles.

FIG. 37 is a setting table illustrating a sixth example configuration of threshold value of the number of driven nozzles.

In the fifth example configuration shown in FIG. 36, different threshold values of the number of driven nozzles are configured depending on the main scanning velocity. However, even if the main scanning velocity is the same, degree of influence of the ink droplet discharging velocity to the landing position Xj depending on the number of driven nozzles can be different in the acceleration stage and the deceleration stage in some cases. Taking that point into account, in the sixth example configuration, different threshold values of the number of driven nozzles can be configured corresponding to the main scanning positions.

In FIG. 37, in this sixth example, the main scanning position is categorized as (i) acceleration stage, (ii) constant velocity stage, and (iii) deceleration stage, and the threshold values of the number of driven nozzles are configured for each category. That is, in the case of (i) acceleration stage, the threshold value of the number of driven nozzles is set to 100 nozzles. In the case of (ii) constant velocity stage, the threshold value of the number of driven nozzles is set to 300 nozzles. In the case of (iii) deceleration stage, the threshold value of the number of driven nozzles is set to 200 nozzles.

Similarly to the cases in FIGS. 32, 33, 34, 35, and 36, the delay data a is selected if the number of driven nozzles is less than the threshold value of the number of driven nozzles, and the delay data b is selected if the number of driven nozzles is either equal to or larger than the threshold value of the number of driven nozzles.

In selecting the delay data in cases shown in FIGS. from 29 to 37, the total number of driven nozzles mounted on all nozzle rows that the recording head 9 includes can be used for that purpose. In addition, the number of driven nozzles mounted on each nozzle row that the recording head 9 includes can be used for that purpose independently.

As described above, in the image recording apparatus in this embodiment, delay amount added to the D/A converting cycle is included in the correction table, the threshold values of the number of discharging nozzles are parameterized, it is determined whether or not it is necessary to correct the driving waveform, and the D/A converting cycle is corrected if necessary. Consequently, in this embodiment, the necessary arithmetic circuit is small, the increase of hardware resources such as memory capacity and the arithmetic circuit can be minimized, and it is possible to perform the correction in accordance with the number of driven nozzles.

Fourth Embodiment

Figure 38:
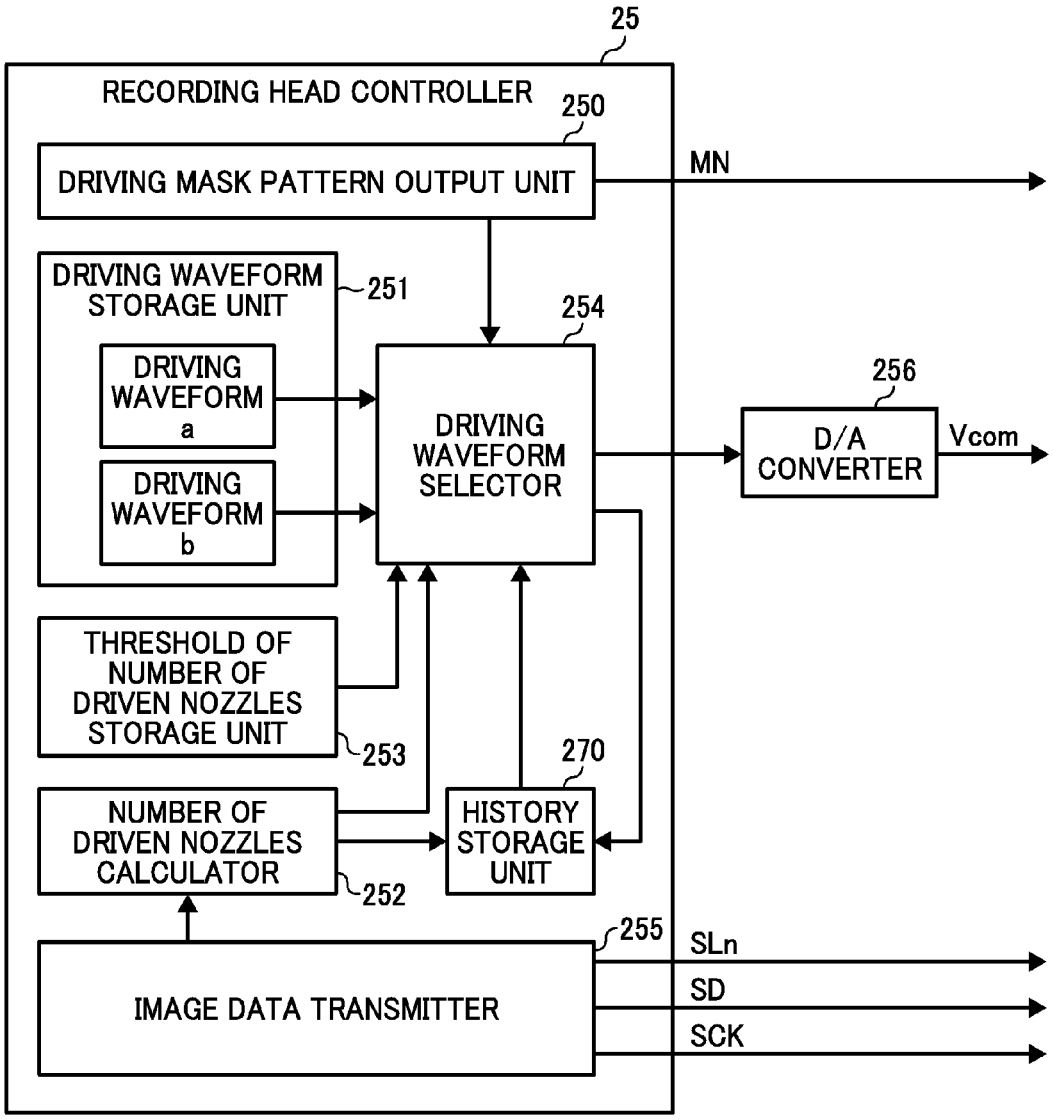
FIG. 38 is a block diagram illustrating an internal configuration of a recording head controller in the inkjet recording apparatus as an embodiment of the present invention.

FIG. 38 is a block diagram illustrating the recording head controller 25 in the image recording apparatus in this embodiment. The recording head controller 25 in this embodiment includes a driving mask pattern output unit 250, a driving waveform storage unit 251, a threshold of number of driven nozzles storage unit (threshold storage unit) 253, a number of driven nozzles calculator 252, a driving waveform selector 254, a history storage unit 270, and an image data transmitter 255. These units can be implemented by software, or these units can be constructed by hardware using electronic circuits.

The driving waveform storage unit 251 stores multiple driving waveform data. The number of driven nozzles calculator 252 calculates the number of nozzles driven simultaneously from the image data. The driving waveform selector 254 selects one driving waveform data from multiple driving waveform data based on the number of driven nozzles. The threshold of number of driven nozzles storage unit 253 stores threshold values used for selecting the driving waveform in a storage area whose value is changeable such as a register. The history storage unit 270 stores a history of the past number of driven nozzles and the driving wave form selected in past times. The driving waveform storage unit 251 stores two driving waveforms a and b. The driving waveform selector 254 selects one driving waveform from the two driving waveform data based on the number of driven nozzles calculated by the number of driven nozzles calculator 252. The number of driven nozzles calculator 252 includes counters for each size of discharged droplets and counts the serial data SD in transferring the image data. The threshold of the number of driven nozzles storage unit 253 stores at least more than one threshold value, and preferably, that value is variable such as a register configuration. The driving waveform selector 254 selects one waveform from the multiple waveforms stored in the driving waveform storage unit 251 and output it based on the number of driven nozzles sent from the number of driven nozzles calculator 252, threshold of the number of driven nozzles, and information sent from the head driving mask pattern output unit 250 and the history storage unit 270. The D/A converter 256 performs analog conversion on the driving waveform selected by the driving waveform selector 254 and outputs it as a head driving waveform Vcom.

Figure 39:
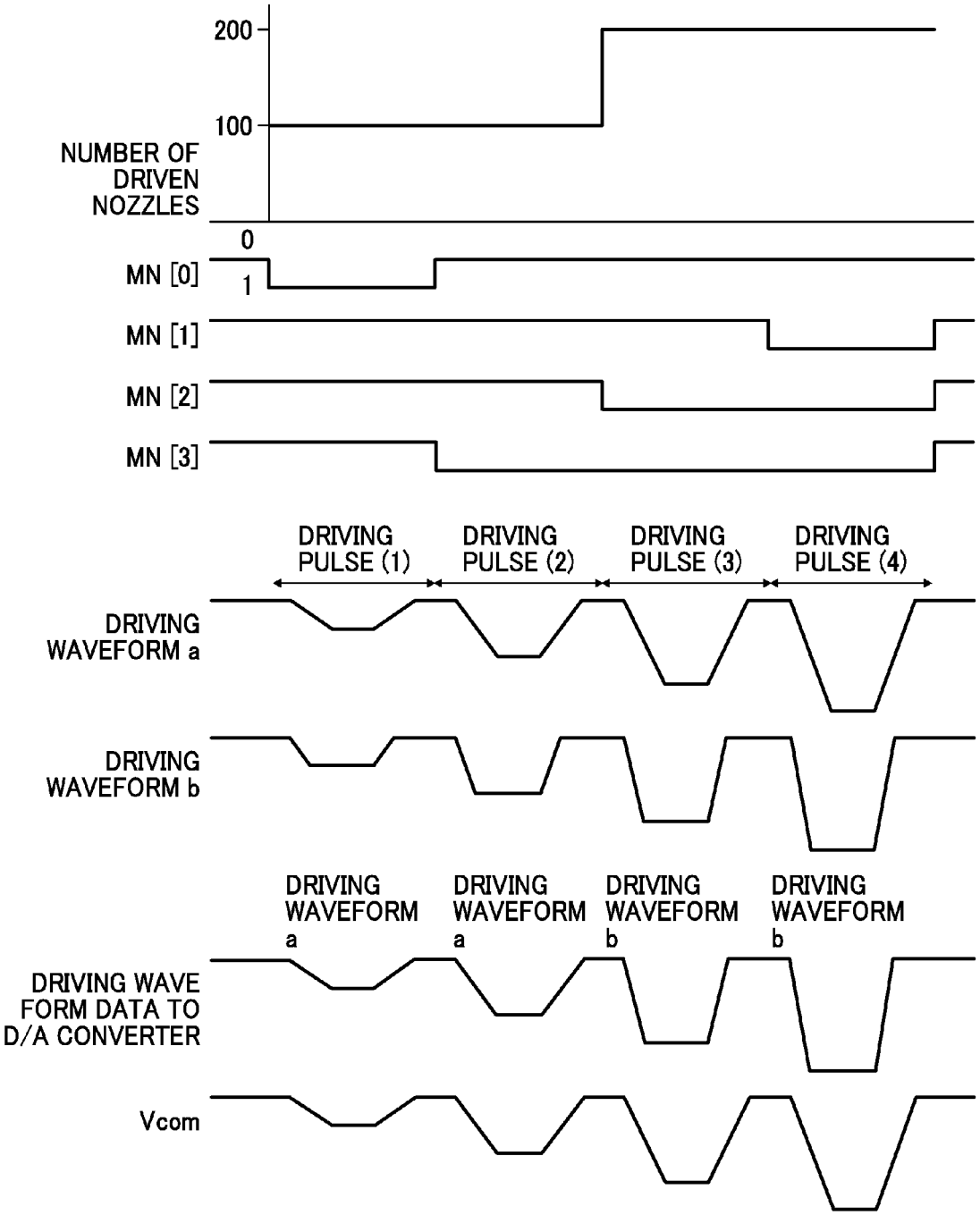
FIG. 39 is a diagram illustrating difference of selected driving waveforms between large number of driven nozzles and small number of driven nozzles as an embodiment of the present invention.

FIG. 39 is a diagram illustrating the driving waveforms selected in accordance with the number of driven nozzles. As shown in FIG. 39, a driving waveform a is appropriate if the number of driven nozzles is small, and a driving waveform b is appropriate if the number of driven nozzles is large. The rising time and the fall time are different between the driving wave forms a and b. The driving waveform a is selected in the case of the driving pulses (1) and (2), and the driving waveform b is selected in the case of the driving pulses (3) and (4). Subsequently, the selected waveform is output to the D/A convertor 256. Consequently, in the acquired head driving waveform Vcom, it is possible to reduce the impact of the number of driven nozzles compared to conventional techniques. That is, in the driving pulses (3) and (4) whose numbers of driven nozzles are large, deviation of the landing positions can be reduced by selecting the driving waveforms in which variance of low width of the driving waveform is small.

Figures 40, 41:
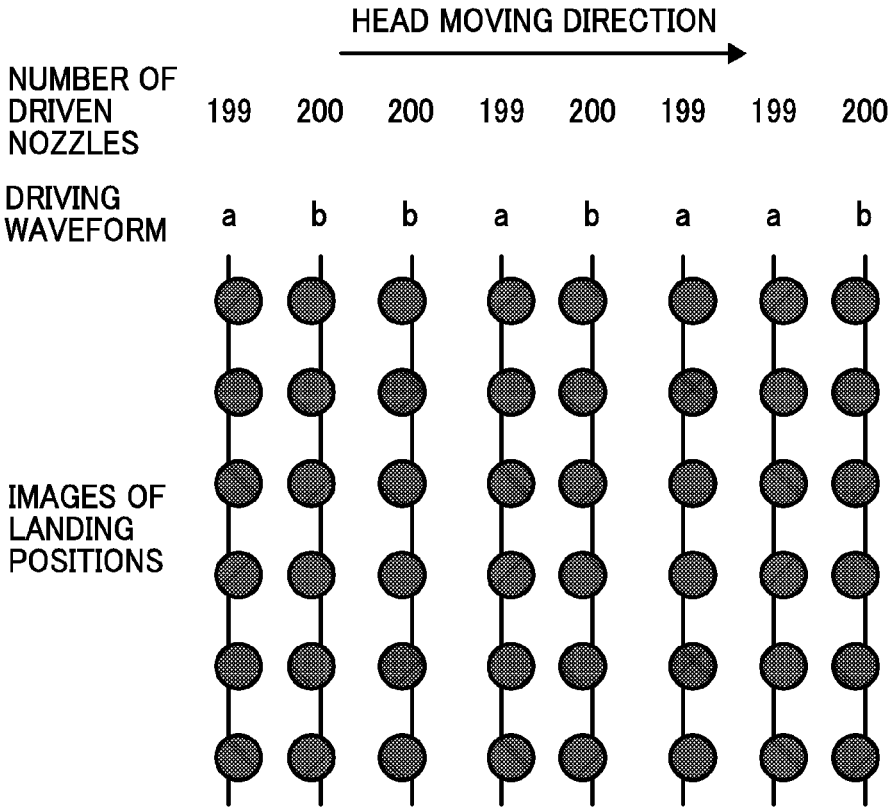
FIG. 40 is a diagram illustrating deviation of landing positions by selecting or switching the driving waveforms as an embodiment of the present invention.
FIG. 41 is a table illustrating a control method of switching the driving waveform using hysteresis characteristics as an embodiment of the present invention.

While it is still possible to suppress, for example, minimize the deviation of the landing positions of the ink droplets if the number of driven nozzles is large, the deviation of the landing positions due to the switch of the driving waveform also occurs. FIG. 40 is a diagram illustrating the deviation of the landing positions by selecting or switching the driving waveforms. Here, it is assumed that the threshold value of driven nozzles is 200 for example, the driving waveform a is used if the number of driven nozzles is less than 200, and the driving waveform b is used if the number of driven nozzles is either more than or equal to 200. As shown in FIG. 39, since the driving pulse is switched from a to b in cases that the number of driven nozzles is 199 and 200 even though the change of load of actuator (capacitance) is minute, the velocity of the ink droplet changes, relative difference of the landing positions occurs, and that results in generating a gap on the printed image. As described above, in the case of image data whose times of stepping over the threshold value (such as gradation and image whose gradation is intermediate around the threshold value) even though the variation of the number of driven nozzles is small, the switching of the driving waveforms can cause negative effects in some cases. To cope with this issue, in this embodiment, various controls are performed to suppress, for example, minimize the deviation of the landing positions due to the switch of the driving waveforms, and those controls are described in detail below.

FIG. 41 is a table illustrating a control method of switching the driving waveform using hysteresis characteristics. As shown in FIG. 41, the driving waveform selector 254 changes into the driving waveform a if the calculated number of driven nozzles is less than 190. By contrast, the driving waveform selector 254 changes into the driving waveform b if the calculated number of driven nozzles is either equal to or larger than 210. In addition, the driving waveform selector 254 maintains previous driving waveform if the number of driven nozzles is either equal to or larger than 190 and less than 210. Consequently, in the case shown in FIG. 41, the threshold of number of driven nozzles storage unit 253 stores 210 as a first threshold value and 190 as a second threshold value. That is, by adopting the hysteresis characteristics that selects the driving waveform based on history of previous driving waveform without changing the driving waveform immediately, it is possible to reduce the number of switching the driving waveforms if the variation of gradation is minute with performing the control of switching the driving waveforms in accordance with the number of discharging times.

FIG. 42 is a table illustrating another control method of switching the driving waveform using hysteresis characteristics. As shown in FIG. 42, variation of the number of driven nozzles from the previous discharge is included in the condition of switching the driving waveforms. In particular, in case the number of driven nozzles is either equal to or larger than 150 and less than 250, the driving waveform b is selected if the variation of the number of driven nozzles increases more than 50. By contrast, in case the number of driven nozzles is either equal to or larger than 150 and less than 250, the driving waveform a is selected if the variation of the number of driven nozzles decreases less than −50. In this case, in the intermediate zone among multiple threshold values (the number of driven nozzles is either equal to or larger than 150 and less than 250), it is possible to make the printing gap small by switching the driving waveforms in the timing that the number of driven nozzles changes drastically and not switching the driving waveforms in the timing that the number of driven nozzles changes modestly. In addition, since the driving waveform is switched in accordance with an area where the density of the printing image changes drastically, the gap becomes unnoticeable. To realize the control method described above, it is needed to store the history of the previous number of driven nozzles and calculate the difference between the number of driven nozzles calculated in the previous driving pulse and the number of driven nozzles calculated in the current driving pulse. In this embodiment, this process is performed by the history storage unit 270.

FIG. 43 is a table illustrating yet another control method of switching the driving waveform using hysteresis characteristics. In FIG. 43, the threshold value of the number of driven nozzles is sloped. That is, as the number of driven nozzles after changing increases, the threshold value of the variation of the number of driven nozzles (a third threshold value) in switching into the driving waveform b becomes low. Therefore, the driving waveform a is switched into the driving waveform b with less change in the number of driven nozzles (increment). By contrast, as the number of driven nozzles after changing becomes small, the threshold value of the variation of the number of driven nozzles (a fourth threshold value) in switching into the driving waveform a becomes high. Therefore, the driving waveform b is switched into the driving waveform a with less change in the number of driven nozzles (decrement). The driving waveform selector 254 modifies the third threshold value and the fourth threshold value. Consequently, the possibility to end up selecting the driving waveform a in the zone whose number of driven nozzles is either equal to or larger than 200 where the driving waveform b is selected under normal circumstance can be reduced. Similarly, the possibility to end up selecting the driving waveform b in the zone whose number of driven nozzles is less than 200 where the driving waveform a is selected under normal circumstance can be reduced.

Figures 44, 45:
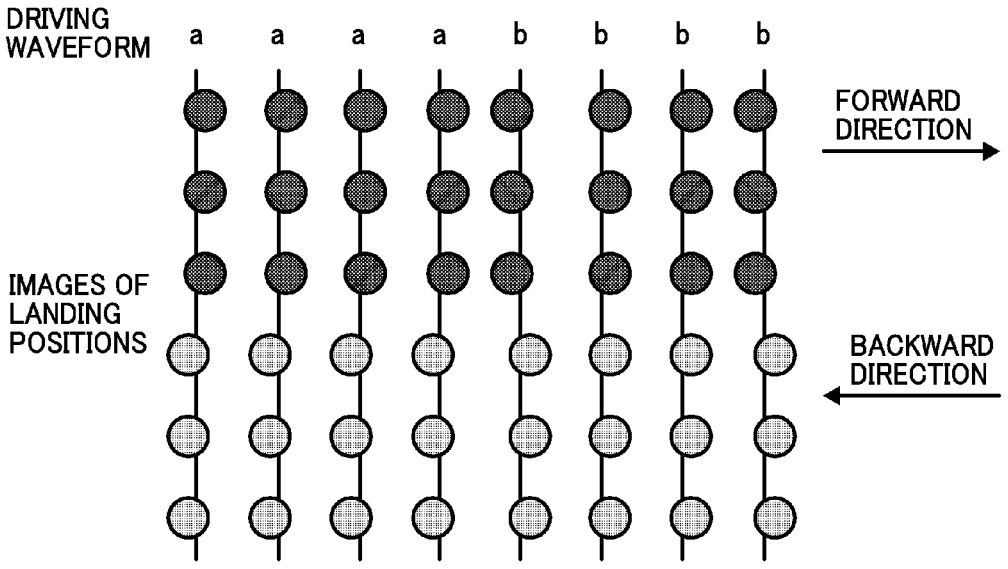
FIG. 44 is a table illustrating an example configuration of threshold value of the number of driven nozzles as an embodiment of the present invention.
FIG. 45 is a diagram illustrating relationship between driving waveforms for each direction of the recording head and deviation of landing positions as an embodiment of the present invention.

FIG. 44 is a table illustrating an example configuration of threshold value of the number of driven nozzles. In FIG. 44, different threshold values of the number of driven nozzles and different threshold values of variation of the number of driven nozzles are configured in case the main scanning direction of the head is forward direction and backward direction. If the position where the gap occurs is the same regardless of the moving direction of the head, the gap looks outstanding since the dots become nondense in the backward direction where the dots become intense in the forward direction. Consequently, as shown in FIG. 44, the points where the gap occurs are shifted to reduce the effect on the image.

FIG. 45 is a diagram illustrating relationship between driving waveforms for each direction of the recording head and deviation of landing positions. In FIG. 45, different threshold values of the number of driven nozzles and different threshold values of variation of the number of driven nozzles are configured in accordance with the number of scans by the recording head. In controlling the inkjet apparatus, printing is performed by multiple scans on the same area in some cases (interleave). In this case, the gap becomes obscurity by distributing the gap point for each scan. It is preferable to configure the number of combination of parameters same as the number of interleaves.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

What is claimed is:

1. An image recording apparatus, comprising:

a recording head controller to transfer image data and a driving waveform to a recording head in conjunction with position information of the recording head, the recording head controller including, a driving waveform storage unit to store driving waveform data, the driving waveform data including at least first driving waveform data having an associated first driving pulse and second driving waveform data having an associated second driving pulse, the first driving pulse and the second driving pulse each having rise and fall times associated therewith, one or more of the rise time and fall time being shorter in the second driving pulse than in the first driving pulse;

a calculator to calculate a number of nozzles driven simultaneously from the image data; and a driving waveform selector to select one driving waveform data from the multiple driving waveform data based on the calculated number of driven nozzles and a threshold value of the number of driven nozzles such that if the calculated number of driven nozzles is greater than or equal to the threshold value the driving waveform selector is configured to drive the recording head using the second driving waveform data.

2. The image recording apparatus according to claim 1, wherein the driving waveform selector selects the driving waveform data in units of pulses of the driving waveform data.

3. The image recording apparatus according to claim 1, further comprising a storage unit that sets the threshold value of the number of driven nozzles.

4. The image recording apparatus according to claim 3, wherein the storage unit sets different threshold values for the number of driven nozzles in units of pulses of the driving waveform data.

5. The image recording apparatus according to claim 3, wherein the storage unit sets different threshold values for the number of driven nozzles in units of combinations of target droplet sizes realized by the driving waveform data.

6. The image recording apparatus according to claim 3, wherein the storage unit sets different threshold values for the number of driven nozzles in accordance with a print mode.

7. The image recording apparatus according to claim 3, wherein the storage unit sets different threshold values for the number of driven nozzles in accordance with detected temperature of the recording head.

8. The image recording apparatus according to claim 3, wherein the storage unit sets different threshold values for the number of driven nozzles in accordance with moving velocity of the recording head.

9. The image recording apparatus according to claim 3, wherein the storage unit sets different threshold values for the number of driven nozzles in accordance with a position of the recording head.

10. A recording method of controlling a recording head of an image recording apparatus, comprising:

storing driving waveform data in a driving waveform storage unit, the driving waveform data including at least first driving waveform data having an associated first driving pulse and second driving waveform data having an associated second driving pulse, the first driving pulse and the second driving pulse each having rise and fall times associated therewith, one or more of the rise time and fall time being shorter in the second driving pulse than in the first driving pulse;

calculating a number of nozzles driven simultaneously from the image data; and selecting one driving waveform data from the multiple driving waveform data based on the calculated number of driven nozzles and a threshold value of the number of driven nozzles such that, if the calculated number of driven nozzles is greater than or equal to the threshold value, the selecting drives the recording head using the second driving waveform data.

11. An image recording apparatus, comprising:

a recording head having a pressurizer for ink liquid and multiple nozzles that discharge the ink liquid pressurized by pressurizer as a liquid droplet; and a recording head controller to drive the pressurizer on each of the nozzles using a common driving waveform based on image data transferred in conjunction with movement of the recording head relative to a recording medium and control discharging velocity of the liquid droplet by changing the driving waveform for driving the pressurizer, the recording head controller comprising:

a first storage unit to store standard driving waveform data that originates the driving waveform;

a second storage unit to store driving waveform correction data for correcting the standard driving waveform data to stabilize the discharging velocity of the liquid droplet in accordance with a number of driven nozzles that discharge the liquid droplet simultaneously;

a calculator to calculate the number of nozzles driven simultaneously from the image data; and a driving waveform calculator to acquire the driving waveform correction data that corresponds to the number of driven nozzles calculated by the calculator from the second storage unit and correct the standard driving waveform data by using the acquired driving waveform correction data.

12. A recording method of using an image recording apparatus including a pressurizer for ink liquid and multiple nozzles that discharges ink liquid pressurized by driving the pressurizer as a liquid droplet, comprising the steps of:

driving the pressurizer on each of the nozzles using a common driving waveform based on image data transferred in conjunction with relative movement of the recording head to recording medium; and controlling discharging velocity of the liquid droplet by changing the driving waveform for driving the pressurizer, the driving step and the controlling step comprising:

storing standard driving waveform data that originates the driving waveform;

storing driving waveform correction data for correcting the standard driving waveform data to stabilize the discharging velocity of the liquid droplet in accordance with a number of driven nozzles that discharge the liquid droplet simultaneously, calculating the number of nozzles driven simultaneously from the image data; and acquiring the driving waveform correction data that corresponds to the number of driven nozzles calculated by the calculator from a driving waveform storage unit and correcting the standard driving waveform data by using the acquired driving waveform correction data.

13. An image recording apparatus that performs recording on a recording medium, comprising:

a recording head to include multiple nozzles; and a recording head controller to transfer image data and a driving waveform to the recording head via a D/A converter, the recording head controller comprising:

a delay data storage unit to store multiple delay data to correct timing of transferring driving waveform data to the D/A converter; and a driving waveform timing generator to select one delay data from the stored delay data based on a number of nozzles driven simultaneously and correct the timing of transferring the driving waveform data to the D/A converter based on the selected delay data, wherein the image recording apparatus changes D/A converting cycle in the D/A converter by correcting the timing of transferring the driving waveform data and minimizes fluctuation of the driving waveform due to fluctuation of the number of the nozzles driven simultaneously.

14. A recording method of using an image recording apparatus, comprising the steps of:

storing multiple delay data to correct timing of transferring driving waveform data to the D/A converter;

selecting one delay data from the stored delay data based on a number of nozzles driven simultaneously and correct the timing of transferring the driving waveform data to the D/A converter based on the selected delay data;

changing D/A converting cycle in the D/A converter by correcting the timing of transferring the driving waveform data; and minimizing fluctuation of the driving waveform due to fluctuation of the number of the nozzles driven simultaneously.

15. An image recording apparatus, comprising:

a calculator to calculate a number of driven nozzles based on input image data;

a storage unit to store multiple driving waveforms whose rising time and fall time are different with each other, a threshold storage unit to store a first threshold of the number of the driven nozzles and a second threshold of the number of the driven nozzles used for selecting the driving waveform to be output from the multiple driving waveforms; and a driving waveform selector to select the driving waveform whose rising time and fall time are long from the multiple driving waveforms if the calculated number of the driven nozzles is either larger than or equal to the first threshold, select the driving waveform whose rising time and fall time are short from the multiple driving waveforms if the calculated number of the driven nozzles is less than the second threshold, and select the currently selected driving waveform ongoingly if the calculated number of the driven nozzles is either larger than or equal to the second threshold and less than the first threshold.

16. A recording method of using an image recording apparatus, comprising the steps of:

calculating a number of driven nozzles based on input image data;

storing multiple driving waveforms whose rising time and fall time are different with each other, storing a first threshold of the number of the driven nozzles and a second threshold of the number of the driven nozzles used for selecting the driving waveform to be output from the multiple driving waveforms; and selecting the driving waveform whose rising time and fall time are long from the multiple driving waveforms if the calculated number of the driven nozzles is either larger than or equal to the first threshold, selecting the driving waveform whose rising time and fall time are short from the multiple driving waveforms if the calculated number of the driven nozzles is less than the second threshold, and selecting the currently selected driving waveform ongoingly if the calculated number of the driven nozzles is either larger than or equal to the second threshold and less than the first threshold.

* * * * *